United States Patent [19]

Nakamura

[11] Patent Number: 4,663,272

[45] Date of Patent: May 5, 1987

[54] SILVER HALIDE PHOTOGRAPHIC MATERIAL CONTAINING A POLYMER WITH A PHOTOGRAPHICALLY USEFUL GROUP WHICH IS RENDERED NON-DIFFUSIVE BY CROSS-LINKING

[75] Inventor: Taku Nakamura, Kanagawa, Japan

[73] Assignee: Fuji Photo Film Co., Ltd., Kanagawa, Japan

[21] Appl. No.: 763,370

[22] Filed: Aug. 7, 1985

[30] Foreign Application Priority Data

Aug. 7, 1984 [JP] Japan ..... 59-165082

[51] Int. Cl.[4] ..... G03C 1/08; G03C 1/84; G03C 7/26; G03C 7/32

[52] U.S. Cl. ..... 430/542; 430/512; 430/544; 430/548; 430/549; 430/552; 430/553; 430/554; 430/555; 430/556; 430/557; 430/558; 430/559; 430/598

[58] Field of Search ..... 430/548, 559, 544, 549, 430/955, 957, 958, 598, 558, 552–557, 512

[56] References Cited

U.S. PATENT DOCUMENTS

| | | | |
|---|---|---|---|
| 3,926,436 | 12/1975 | Monbaliu et al. | 430/556 |
| 4,436,808 | 3/1984 | Yagihara et al. | 430/548 |
| 4,444,870 | 4/1984 | Hirano et al. | 430/548 |
| 4,474,870 | 10/1984 | Yagihara et al. | 430/548 |
| 4,518,687 | 5/1985 | Hirano et al. | 430/548 |

FOREIGN PATENT DOCUMENTS

| | | | |
|---|---|---|---|
| 0133262 | 2/1985 | European Pat. Off. | 430/548 |
| 0228252 | 12/1984 | Japan | 430/548 |

*Primary Examiner*—John E. Kittle
*Assistant Examiner*—Mukund J. Shah
*Attorney, Agent, or Firm*—Sughrue, Mion, Zinn, Macpeak & Seas

[57] ABSTRACT

A silver halide photographic material is described comprising at least one layer which contains at least (1) a polymer comprising as constitutional components thereof a repeating unit having a photographically useful group and at least one repeating unit having a sulfinic acid group or a sulfinate group, and (2) a compound having at least one functional group capable of reacting with at least one of a sulfinic acid group and sulfinate group and at least one functional group capable of reacting with at least one of a sulfinic acid group, a sulfinate group and a primary amino group.

Said photographic group-containing polymer (1) may be fixed in a photographic layer according to the present photographic material, and does not substantially migrate therefrom during development or other photographic treatment, thus resulting in formation of color images of high density.

27 Claims, No Drawings

SILVER HALIDE PHOTOGRAPHIC MATERIAL CONTAINING A POLYMER WITH A PHOTOGRAPHICALLY USEFUL GROUP WHICH IS RENDERED NON-DIFFUSIVE BY CROSS-LINKING

FIELD OF THE INVENTION

The present invention relates to photographic materials, and, in particular, to silver halide photographic materials containing at least one polymer containing a photographically useful group, and which is rendered non-diffusive by crosslinking to each other and/or with gelatin using a compound having two or more functional groups capable of reacting with a sulfinic acid group or a primary amino group.

BACKGROUND OF THE INVENTION

Each layer of a silver halide photographic material contains, in general, various kinds of photographic additives, such as coupler, ultra-violet absorbent, anti-oxidant, stabilizer, color-stain inhibitor, anti-fogging agent, dye, etc.; and various methods have heretofore been proposed for fixation of specific photographic additivess in a specific layer comprising gelatin or the like hydrophilic binder.

For instance, one prior art method is disclosed, for example, in U.S. Pat. Nos. 2,322,029, 2,360,289, 2,533,514 and 2,801,170, where a hydrophobic coupler having an oil-soluble group and a photographically useful group is dissolved in a solvent having a high boiling point, and the resulting solution is dispersed in a hydrophilic polymer solution to obtain a coupler-dispersion, which is coated on a photographic support. Another prior art method is disclosed, for example, in Japanese Patent Application (OPI) No. 59943/76 (The term "OPI" as used herein refers to a published unexamined Japanese Patent Application.), where a hydrophobic coupler having an oil-soluble group and a photographically useful group is dissolved in a water-compatible organic solvent and an aqueous polymer latex is gradually added to the resulting solution and admixed therewith to incorporate said hydrophobic coupler in said latex particles, and then the mixture obtained is dispersed in a hydrophilic polymer and then coated on a photographic support.

However, these prior art methods include some troublesome defects as mentioned below. The former method requires an emulsification step requiring a large amount of energy, and the coupler, etc., are often deteriorated during said step, and thus, this is not always advantageous. On the other hand, in the latter method, the amount of the hydrophobic coupler to be incorporated in the latex particles must inevitably be limited in order to prevent the aggregation of said latex particles, and, therefore, desired photographic characteristics can not always be obtained.

In addition to said above prior art methods, still another methods are known, as disclosed, e.g., in *Research Disclosure,* No. 190, pp. 65–66 (1980), U.S. Pat. Nos. 3,926,436 and 4,397,943, and German Pat. No. 1,547,863, where coupler, ultra-violet absorbent and stabilizer are added, each in the form of a water-soluble polymer, to a hydrophilic polymer binder, and the solution obtained is coated on a photographic support. However, this method is also defective in that the water-soluble polymers are not rendered sufficiently non-diffusive and so these are apt to flow out in a developer during development. In order to provide non-diffusiveness to a polymer, water-soluble polymers have been developed, having a reactive group such as vinylsulfone group, active ester group, active methylene group, primary amino group, epoxy group, etc. together with a photographically useful group, said reactive group being able to be cross-linked with gelatin directly or via a hardening agent, for example, as described in Research Disclosure, No. 17825 (1979), U.S. Pat. Nos. 4,215,195, 3,859,096 and 3,625,694 and Japanese Patent Application (OPI) Nos. 27139/83 and 142524/81.

However, said photographically useful group-containing water-soluble reactive polymer do not have sufficient reactivity with gelatin or a hardening agent, and so to provide complete non-diffusiveness to said polymers is difficult. For example, in the case of a water-soluble polymer which has a photographically useful group a coupler residue capable of forming a dye by coupling with an oxidation product of an aromatic primary amine developing agent, if said polymer is not sufficiently made non-diffusive, color stain is apt to occur, and furthermore the polymer often flows out during development treatment, resulting in decrease of the density of the formed images. In the case of a water-soluble polymer having a residue derived from a reductive color stain-inhibitor as a photographically useful group, if the non-diffusiveness of said polymer is insufficient, the polymer also includes problems of color-stain and decrease of the density of the formed images.

In addition, said conventional reactive groups such as vinylsulfone group, active ester group, active methylene group and epoxy group are per se hydrophobic. Accoridngly, if the polymers themselves containing such hydrophobic group are to be made water-soluble, it is necessary to copolymerize them with a substantial amount of hydrophilic monomer, in addition to a monomer having said reactive group or a monomer having a photographically useful group. Under the situation, the ratio of the amount of said monomers having the reactive group or a photographically useful group must be limited. However, if the ratio of the reactive group-containing monomer is made small, sufficient non-diffusiveness cannot be attained; and if the ratio of the photographically useful group-containing monomer is made small, sufficient photographic characteristics cannot be attained. These have been troublesome problems.

SUMMARY OF THE INVENTION

One object of the present invention is to provide a novel method for fixation (i.e. attainment of non-diffusiveness) of a compound having a photographically useful group in a definite layer.

The other object of the present invention is to provide a silver halide photographic material having improved photographic characteristics, which has a photographically useful group-containing polymer as being fixed (i.e. made non-diffusive) in a definite layer by a novel method.

Accordingly, the present invention provides a silver halide photographic material comprising at least one layer which contains at least (1) a polymer comprising as constitutional components thereof a repeating unit having a photographically useful group and at least one repeating unit having a sulfinic acid group or a sulfinate group, and (2) a compound having at least one functional group capable of reacting with at least one of a sulfinic acid group and sulfinate group and at least one functional group capable of reacting with at least one of a sulfinic acid group, a sulfinate group and a primary amino group.

DETAILED DESCRIPTION OF THE INVENTION

"Photographically useful group" as used herein refers to a substituent derived from photographic compounds which may be used in silver halide photographic materials, including a photographic dye, development inhibitor, development accelerator, coupler, competing coupler, development inhibitor-releasing compound (DIR compound), developing agent, development auxiliary, bleaching inhibitor, bleaching accelerator, bleaching accelerator-releasing compound (BAR compound), silver halide solvent, silver complexing agent, fogging agent, anti-fogging agent, stabilizer, chemical sensitizer, spectral sensitizer, de-sensitizer, ultra-violet absorbent, antioxidant, development accelerator-releasing compound, as well as precursors thereof.

Preferred examples of photographically useful group-containing repeating units which may be used in the present invention include those represented by formula (A)

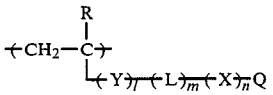

wherein

R is hydrogen atom or an alkyl group having from 1 to 6 carbon atoms;

Y is

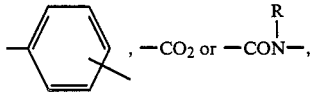

wherein R has the same meaning as above;

L is a divalent bonding group having from 1 to 12 carbon atoms;

X is —O—, —CO—, $—CO_2$, $—SO_2—$,

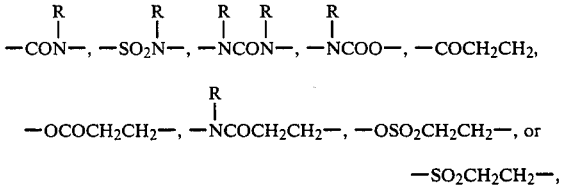

wherein R has the same meaning as above;

Q is a photographically useful group; and l, m, and n are each independently 0 or 1.

Preferred embodiments of the photographically useful group-containing repeating units of said formula (A) are explained in greater detail in the following description.

R represents hydrogen atom or an alkyl group having from 1 to 6 carbon atoms such as methyl group, ethyl group, n-propyl group, iso-propyl group, n-butyl group, tert-butyl group, iso-butyl group, sec-butyl group, n-amyl group, tert-amyl group, or n-hexyl group; and is especially preferably a hydrogen atom, a methyl group, or an ethyl group.

Y represents

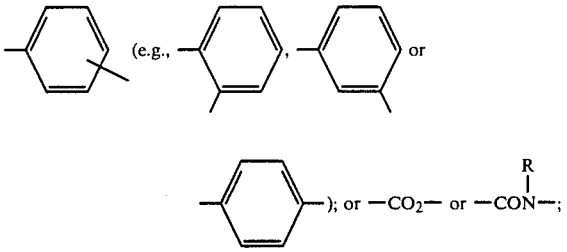

R is selected from the group as mentioned above; for example,

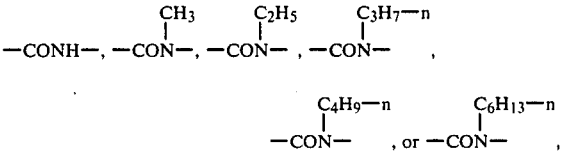

and in particular, Y is especially preferably

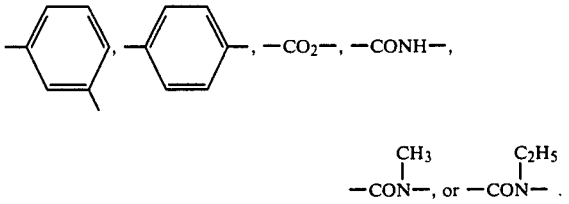

L represents a divalent bonding group having from 1 to 12 carbon atoms, for example, an alkylene group such as methylene group, ethylene group, methylmethylene group, dimethylmethylene group, trimethylene group, tetramethylene group, pentamethylene group, hexamethylene group, octamethylene group, or decamethylene group; or an arylene group such as o-phenylene group, m-phenylene group, p-phenylene group, or naphthylene group; or

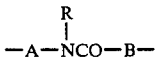

(in which R has the same meaning as above, and A and B represent an alkylene group having from 1 to 10 carbon atoms or an arylene group having from 6 to 10 carbon atoms), such as $—CH_2NHCOCH_2—$, $—CH_2NHCOCH_2CH_2—$, $—CH_2CH_2NHCOCH_2—$, $—CH_2CH_2NHCOCH_2CH_2—$, $—CH_2CH_2CH_2NHCOCH_2CH_2—$

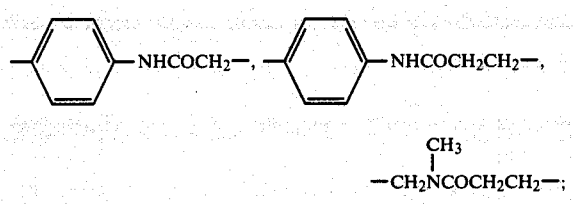

or —A—$CO_2$—B— (in which R, A, and B have the same meanings as above), such as

—$CH_2OCOCH_2$—,

—$CH_2OCOCH_2CH_2$—,

—$CH_2CH_2OCOCH_2$—,

—$CH_2CH_2OCOCH_2CH_2$—,

—$CH_2CH_2CH_2OCOCH_2CH_2$—,

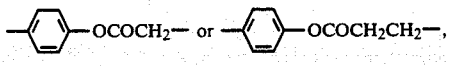

A part of hydrogen atoms in said alkylene group and arylene group may, optionally, be substituted by an aryl group (such as a phenyl group, or a tolyl group), nitro group, hydroxyl group, cyano group, an alkoxy group (such as a methoxy group), an aryloxy group (such as a phenoxy group), an alkylcarbonyloxy group (such as an acetoxy group), an arylcarbonyloxy group (such as a benzoyloxy group), an alkylcarbonylamino group (such as an acetylamino group), an arylcarbonylamino group (such as a benzoylamino group), a carbamoyl group, an alkylcarbamoyl group (such as a methylcarbamoyl group or ethylcarbamoyl group), a dialkylcarbamoyl group (such as a dimethylcarbamoyl group), an arylcarbamoyl group (such as a phenylcarbamoyl group), an alkylsulfonyl group (such as a methylsulfonyl group), an arylsulfonyl group (such as a phenylsulfonyl group), an alkylsulfonamido group (such as a methanesulfonamido group), an arylsulfonamido group (such as a phenylsulfonamido group), a sulfamoyl group, an alkylsulfamoyl group (such as an ethylsulfamoyl group), a dialkylsulfamoyl group (such as a dimethylsulfamoyl group), an arylsulfamoyl group, carboxyl group, an alkoxycarbonyl group (such as methoxycarbonyl group), a halogen atom (such as a fluorine atom, chlorine atom, bromine atom), etc.

L is especially preferably a methylene group, ethylene group, methylmethylene group, dimethylmethylene group, trimethylene group, tetramethylene group, pentamethylene group, m-phenylene group, p-phenylene group, —$CH_2NHCOCH_2$—, —$CH_2NHCOCH_2CH_2$—, —$CH_2OCOCH_2CH_2$—, or —$CH_2CH_2OCOCH_2CH_2$—.

X represents —O—, —CO—, —$CO_2$—, —$SO_2$—,

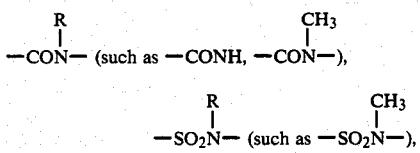

-continued

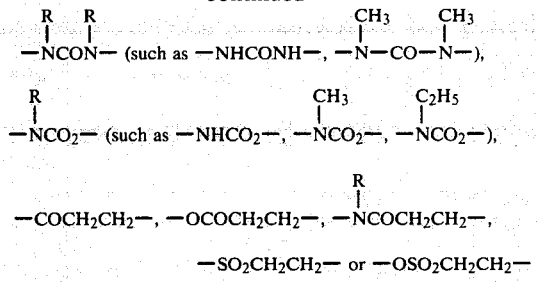

R has the same meaning as above; and especially preferably —O—, —CO—, —$CO_2$—, —$SO_2$—, —CONH—, —NHCONH—, —$NHCO_2$—, —$NHCOCH_2CH_2$, or —$SO_2CH_2CH_2$—.

Q represents a photographically useful group. For example, Q represents a coupler group capable of forming a dye by coupling with an aromatic primary amine developing agent. As for a cyan coupler group, a phenoltype group of the following formula (I)-1 or a naphthol-type group of the following formula (I)-2 is preferred. The asterisk mark * hereinafter shows the position of the bond to X.

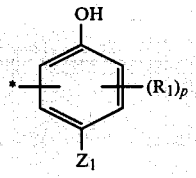

(I)-1

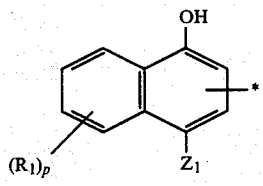

(I)-2

In said formulae (I)-1 and (I)-2, $R_1$ represents an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an arylcarbamoyl group, an arylamido group, an arylsulfamoyl group, an arylsulfonamido group or an arylureido group; p is an integer of 0 to 3, and q is an integer of 0 to 4.

$Z_1$ represents hydrogen atom, a halogen atom, sulfo group, an acyloxy group, an alkoxy group, an aryloxy group, a heterocyclic oxy group, an alkylthio group, an arylthio group or a heterocyclic thio group.

Groups recited for $R_1$ and $Z_1$ may, optionally, be substituted. Examples of substituents thereon include an aryl group (such as phenyl group), nitro group, hydroxy group, cyano group, sulfo group, an alkoxy group (such as methoxy group), an aryloxy group (such as phenoxy group), an acyloxy group (such as acetoxy group), an acylamino group (such as acetylamino group), an alkylsulfonamido group (such as methanesulfonamido group), an alkylsulfamoyl group (such as methylsulfamoyl group), a halogen atom (such as fluorine atom, chlorine atom, bromine atom), carboxyl group, an alkylcarbamoyl group (such as methylcarbamoyl group), an alkoxycarbonyl group (such as methoxycarbonyl group), an alkylsulfonyl group (such as methylsulfonyl group), an alkylthio group (such as β-carboxyethylthio group), etc. In the case that said group is substituted by two or more of said substituents, these may be same or different.

As for a magenta coupler group, pyrazolone-type, pyrazolotriazole-type, and imidazopyrazole-type groups of the following formulae (I)-3 through (I)-14 are preferred.

(I)-3

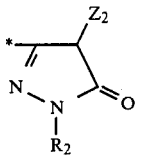

(I)-4

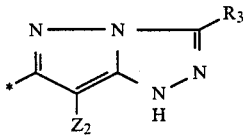

(I)-5

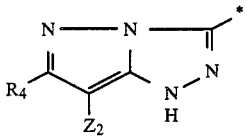

(I)-6

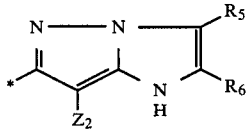

(I)-7

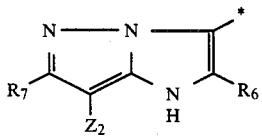

(I)-8

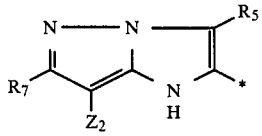

(I)-9

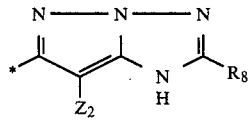

(I)-10

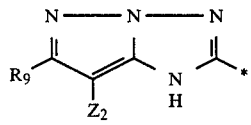

(I)-11

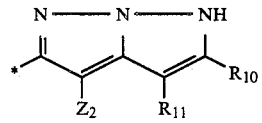

(I)-12

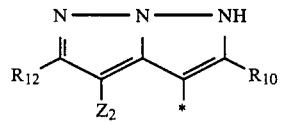

-continued (I)-13

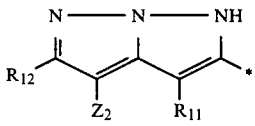

(I)-14

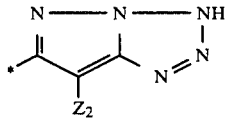

$R_2$ represents a conventional substituent which is well known as a substituent on 1-position of a 2-pyrazolin-5-one coupler, for example, an alkyl group, a substituted alkyl group (such as a halo-alkyl group, e.g., fluoroalkyl, or a cyano-alkyl group, a benzyl-alkyl group), an aryl group or a substituted aryl group (examples of substituents thereon is an alkyl group such as a methyl group or ethyl group), an alkoxy group (such as a methoxy group or ethoxy group), an aryloxy group (such as a phenyloxy group), an alkoxycarbonyl group (such as a methoxycarbonyl group), an acylamino group (such as an acetylamino group), a carbamoyl group, an alkylcarbamoyl group (such as a methylcarbamoyl group or ethylcarbamoyl group), a dialkylcarbmoyl group (such as a dimethylcarbamoyl group), an arylcarbamoyl group (such as a phenylcarbamoyl group), an alkylsulfonyl group (such as a methylsulfonyl group), an arylsulfonyl group (such as a phenylsulfonyl group), an alkylsulfonamido group (such as a methanesulfonamido group), an arylsulfonamido group (such as a phenylsulfonamido group), a sulfamoyl group, an alkylsulfamoyl group (such as an ethylsulfamoyl group), a dialkylsulfamoyl group (such as a dimethylsulfamoyl group), an arylsulfamoyl group, an alkylthio group (such as a methylthio group), an arylthio group (such as a phenylthio group), cyano group, nitro group, a halogen atom (such as a fulorine atom, chlorine atom, bromine atom), etc. In case said group is substituted by two or more of said substituents, these may be same or different. Especially preferably, substituents are halogen atom, alkyl group, alkoxy group, alkoxycarbonyl group and cyano group.

$R_3$, $R_4$, $R_5$, $R_6$, $R_7$, $R_8$, $R_9$, $R_{10}$, $R_{11}$ and $R_{12}$ are each independently a hydrogen atom or hydroxyl group, or represent an unsubstituted or substituted alkyl group (preferably having from 1 to 20 carbon atoms, such as a methyl group, propyl group, t-butyl group, trifluoromethyl group, tridecyl group), an aryl group (preferably having from 6 to 20 carbon atoms, such as phenyl group, 4-t-butylphenyl group, 2,4-di-t-amylphenyl group, 4-methoxyphenyl group), a heterocyclic group (such as a 2-furyl group, 2-thienyl group, 2-pyrimidinyl group, 2-benzthiazolyl group), an alkylamino group (preferably having from 1 to 20 carbon atoms, such as a methylamino group, diethylamino group, t-butylamino group), an acylamino group (preferably having from 2 to 20 carbon atoms, such as an acetylamino group, propylamido group, benzamido group), an anilino group (such as phenylamino group, 2-chloroanilino group), an alkoxycarbonyl group (preferably having from 2 to 20 carbon atoms, such as a methoxycarbonyl group butoxycarbonyl group, 2-ethylhexyloxycarbonyl group), an alkylcarbonyl group (preferably having from 2 to 20 carbon atoms, such as an acetyl group, butyl-carbonyl group, cyclohexylcarbonyl group), an arylcarbonyl group (preferably having from 7 to 20 carbon atoms, such as a benzoyl group, 4-t-butylbenzoyl group), an alkylthio group (preferably having from 1 to 20 carbon atoms, such as a methylthio group, octylthio group, 2-phenoxyethylthio group), an arylthio group (preferably having from 6 to 20 carbon atoms, such as a phenylthio group, 2-butoxy-5-t-octylphenylthio group), a carbamoyl group (preferably having from 1 to 20 carbon atoms, such as an N-ethylcarbamoyl group, N,N-dibutylcarbamoyl group, N-methyl-N-butylcarbamoyl group), a sulfamoyl group (preferably $NH_2SO_2$— and a group having from 1 to 20 carbon atoms, such as an N-ethylsulfamoyl group, N,N-diethylsulfamoyl group, N,N-dipropylsulfamoyl group) or an alkyl sulfonamido group (preferably having from 1 to 20 carbon atoms, such as a methanesulfonamido group), an arylsulfonamido group (preferably having from 6 to 20 carbon atoms, such as benzenesulfonamido group, p-toluenesulfonamido group).

$Z_2$ represents hydrogen atom, a halogen atom, or a split off group which is bonded at a coupling position via an oxygen, nitrogen, or sulfur atom. In the case $Z_2$ is bonded at a coupling position via an oxygen, nitrogen, or sulfur atom, said atom is bonded with an alkyl group, an aryl group, an alkylsulfonyl group, an arylsulfonyl group, an alkylcarbonyl group, an arylcarbonyl group or a heterocyclic ring residue. In addition, in case $Z_2$ is bonded at a coupling position via nitrogen atom, this may form, including said nitrogen atom, a 5- or 6-membered ring (such as an imidazolyl group, pyrazolyl group, triazolyl group, or tetrazolyl group).

As for a yellow dye forming coupler group, an acylacetanilide-type group of formula (I)-15 and benzoylacetanilide-type groups of formulae (I)-16 and (I)-17 are preferred.

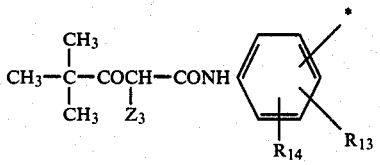
(I) - 15

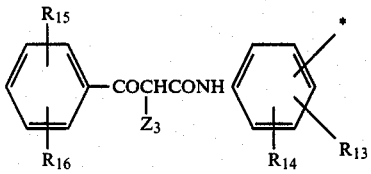
(I) - 16

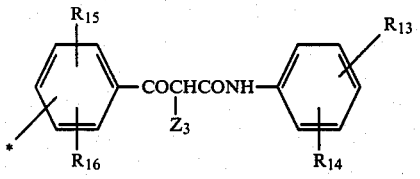
(I) - 17

$R_{13}$, $R_{14}$, $R_{15}$ and $R_{16}$ each independently represents a hydrogen atom or a substituent which is conventional and well known in a yellow coupler group, for example, an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an alkyl-substituted succinimido group, an aryloxy group, an aryloxycarbonyl group, an arylcarbamoyl group, an arylamido group, an arylsulfamoyl group, an arylsulfonamido group, an arylureido group, carboxyl group, sulfo group, nitro group, cyano group or thiocyano group.

$Z_3$ represents hydrogen atom or —$OR_{17}$ (in which $R_{17}$ represents an aryl group, a substituted aryl group or a heterocyclic group), or represents

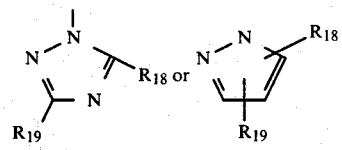

wherein $R_{18}$ and $R_{19}$ each independently represents hydrogen atom, a halogen atom, a carboxylic acid ester residue, an amino group, an alkyl group, an alkylthio group, an alkoxy group, an alkylsulfonyl group, an alkylsulfinyl group, a carboxylic acid group, a sulfonic acid group, a substituted or unsubstituted phenyl group, or a heterocyclic ring, or represents

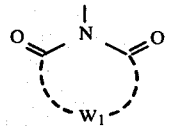

wherein $W_1$ is an atomic group necessary for forming a 4 to 7 membered ring together with

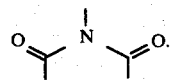

Especially preferred among the foregoing are

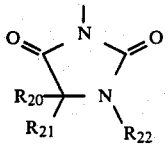

and

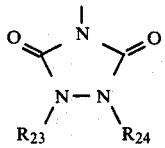

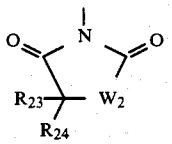

wherein $R_{20}$, $R_{21}$, and $R_{22}$ each independently represents a hydrogen atom, an alkyl group, an aryl group, an aralkyl group, or an acyl group; $W_2$ represents an oxygen atom or a sulfur atom; $R_{23}$ and $R_{24}$ each independently represents a hydrogen atom, an alkyl group, an aryl group, an alkoxy group, an aryloxy group or hydroxy group.

Preferred examples of repeating units of the above-described formula (A), which have as a photographically useful group a coupler group capable of forming a dye by coupling with an aromatic primary amine developer, are set forth below.

Cyan-forming repeating units
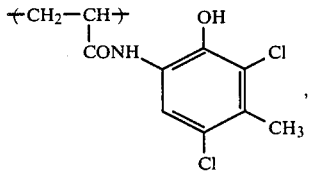
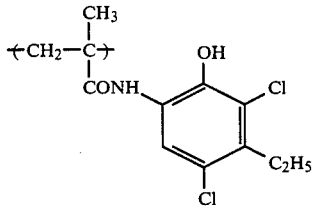
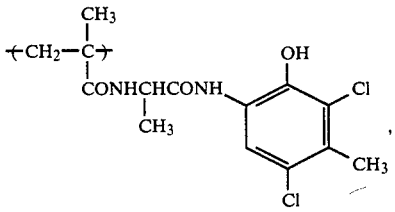
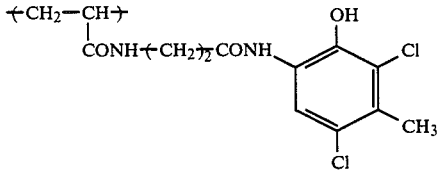
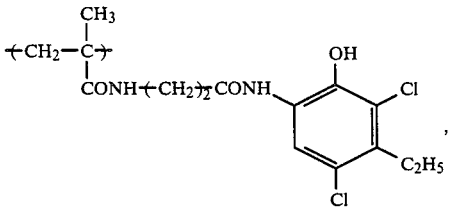
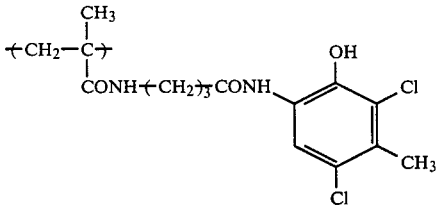
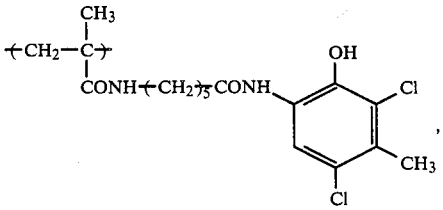
-continued
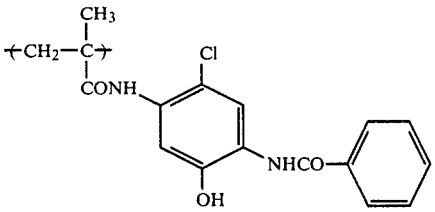
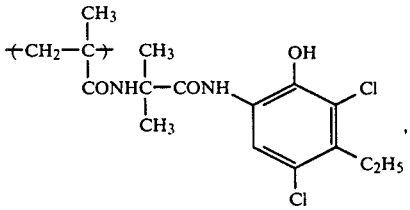
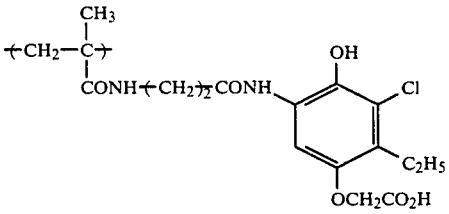
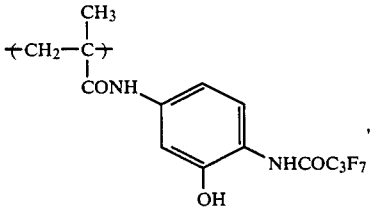
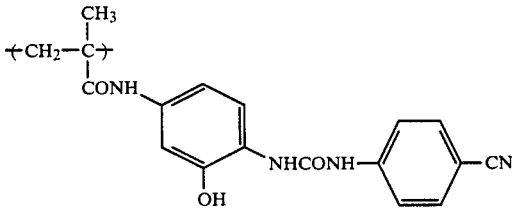
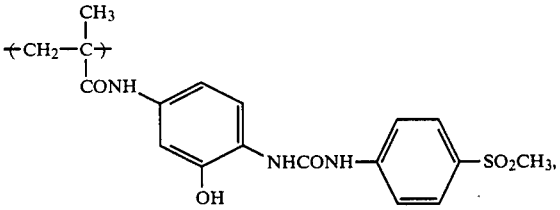
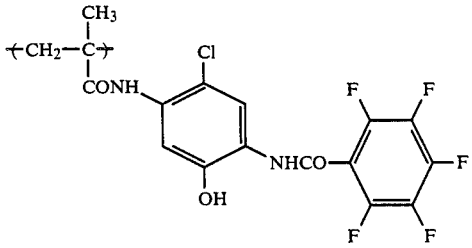

-continued
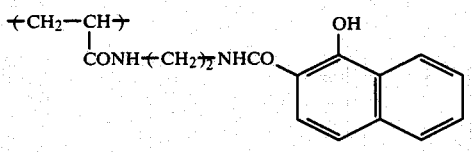
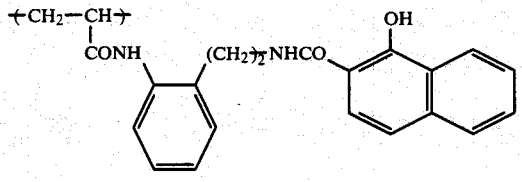
Magenta-forming repeating units
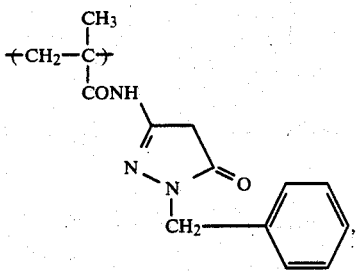
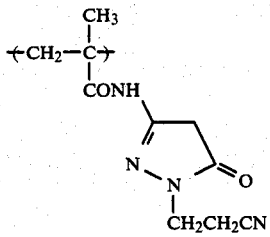
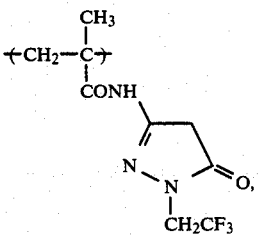
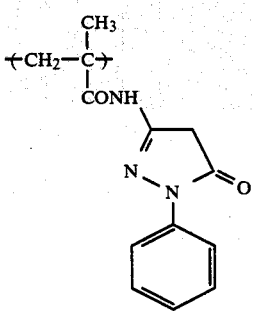
-continued
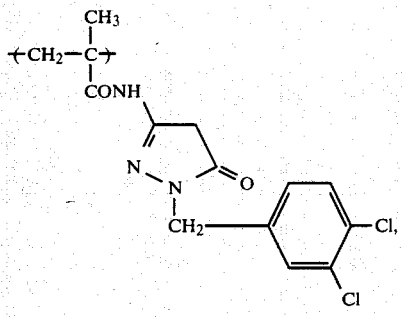
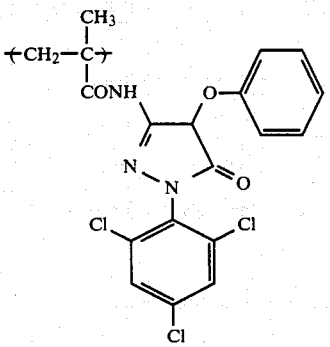
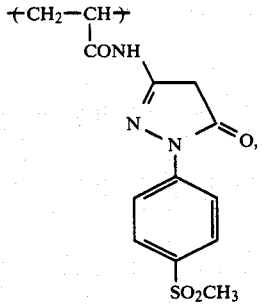
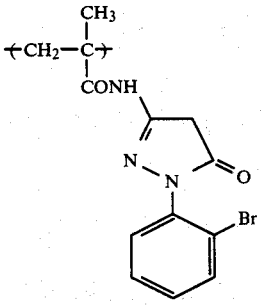
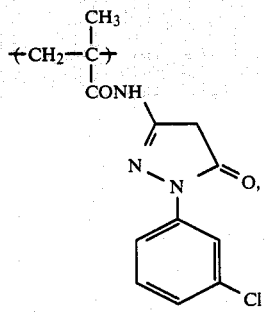

-continued
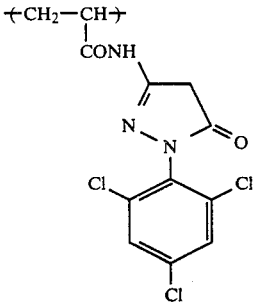
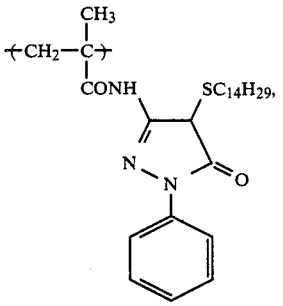
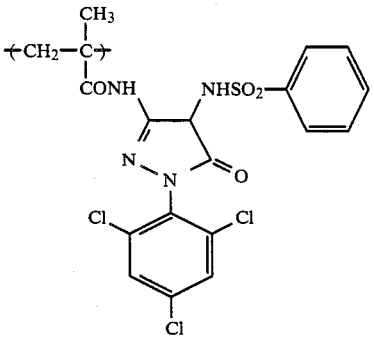
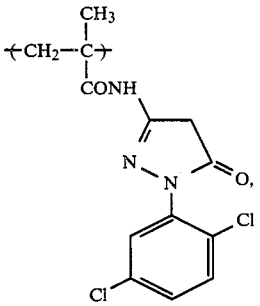
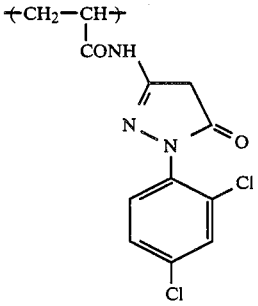
-continued
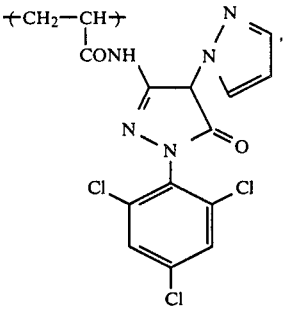
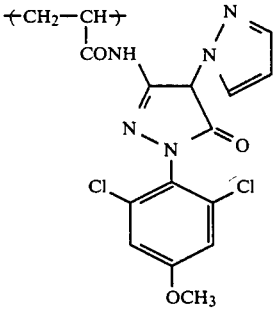
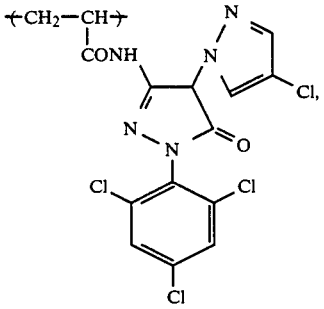
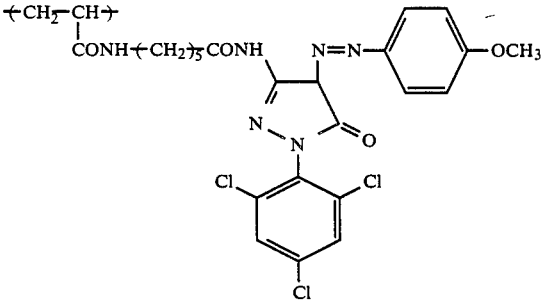

-continued
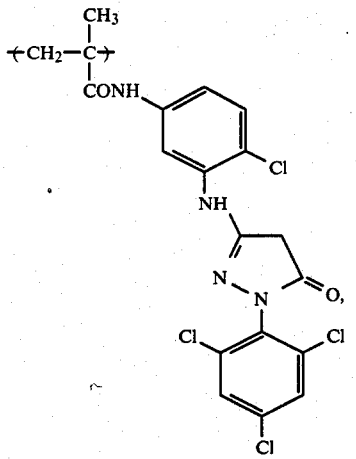
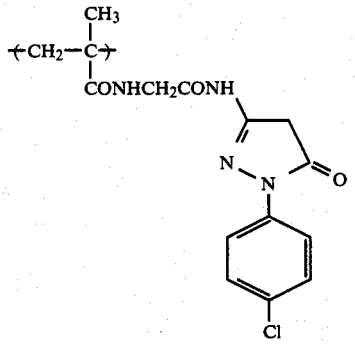
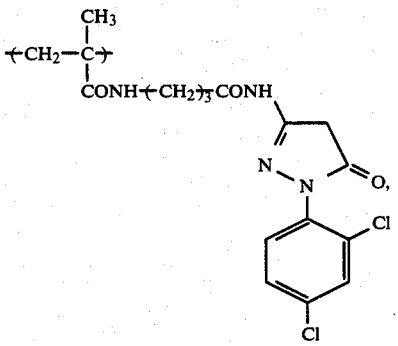
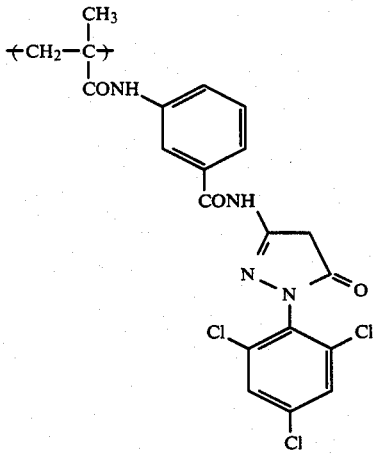
-continued
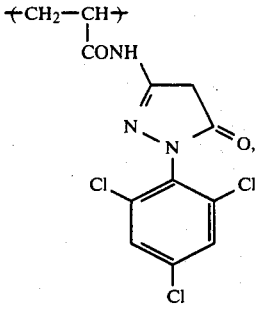
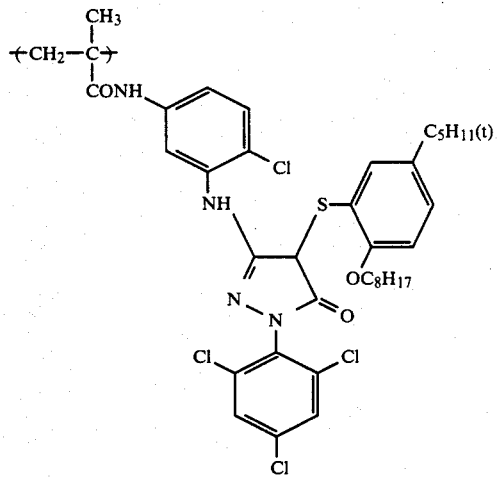
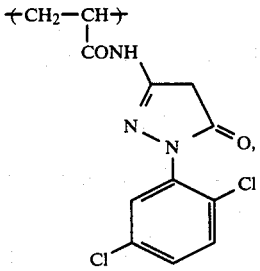
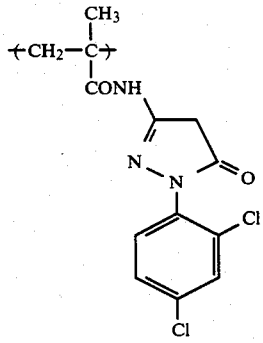

-continued
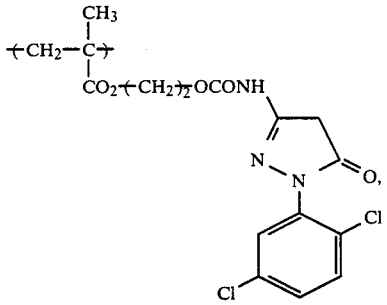
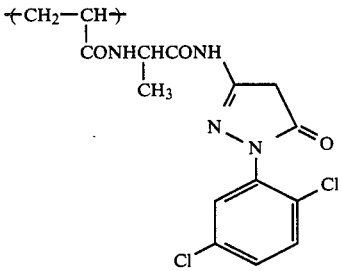
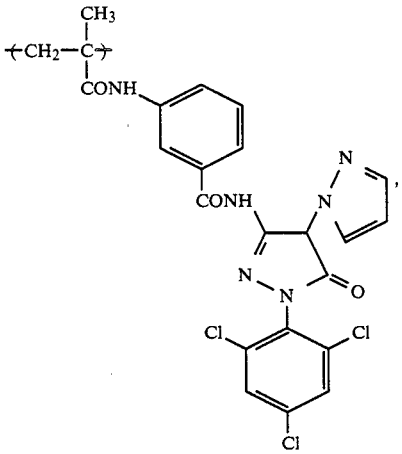
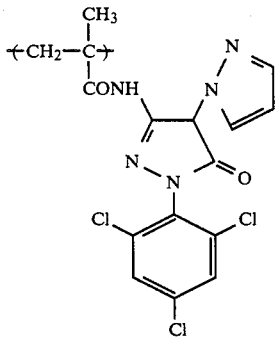
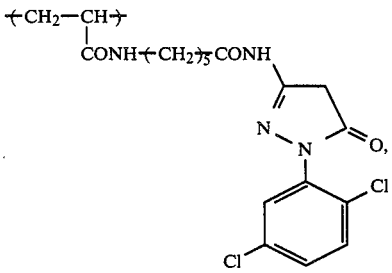
-continued
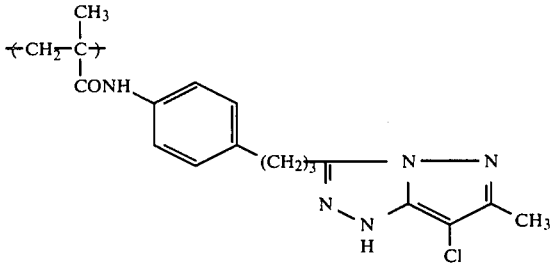
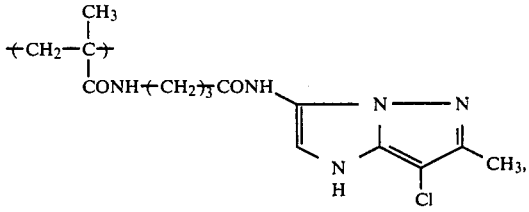
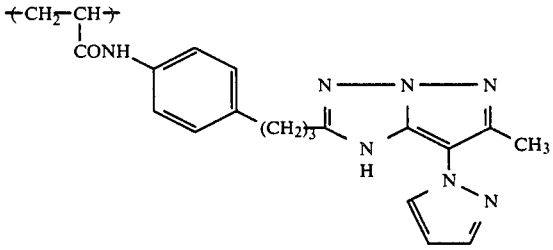
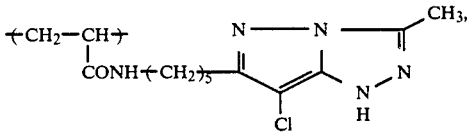
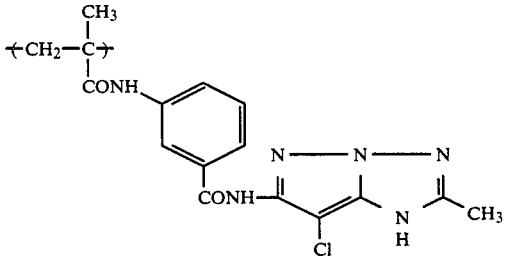
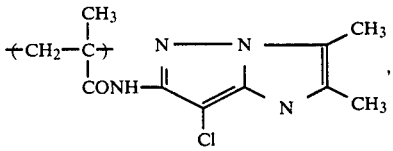
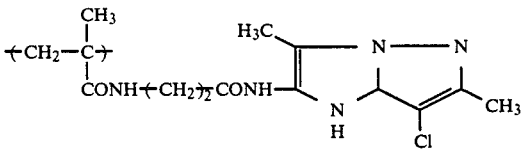
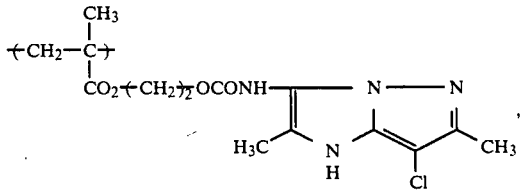

-continued
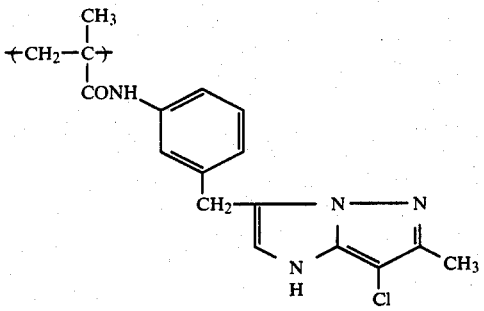
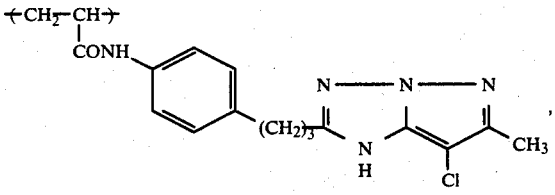
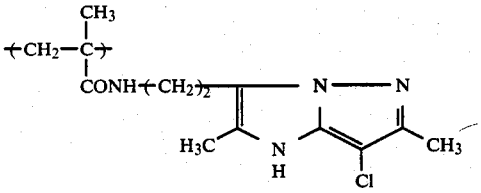
Yellow-forming repeating units
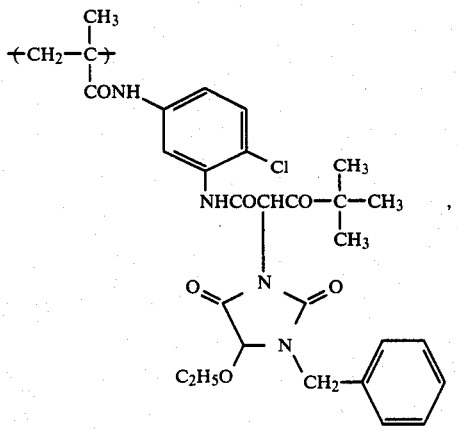
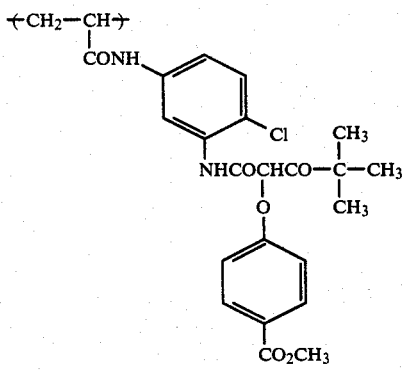
-continued
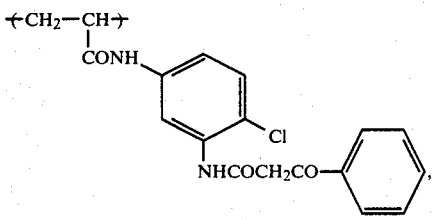
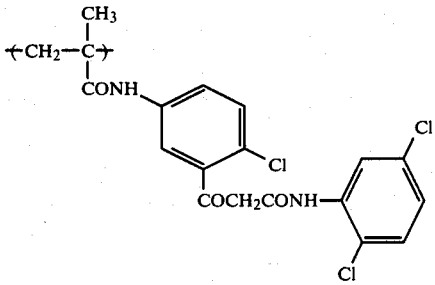
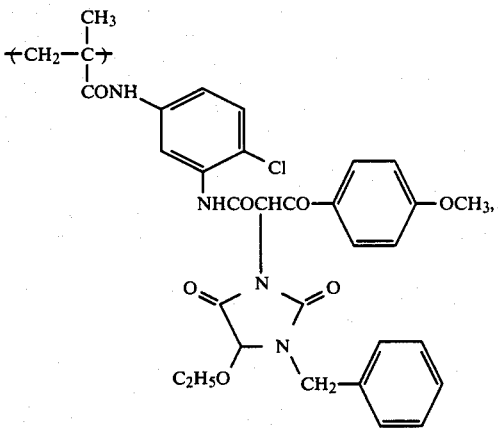
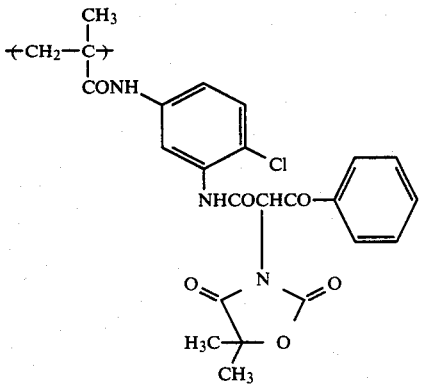
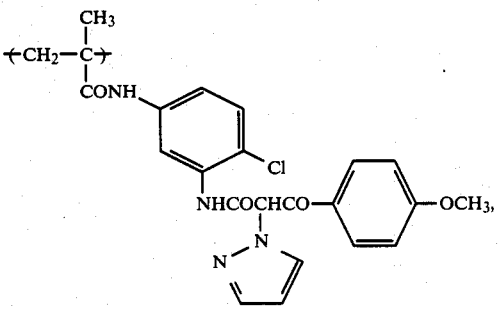

-continued

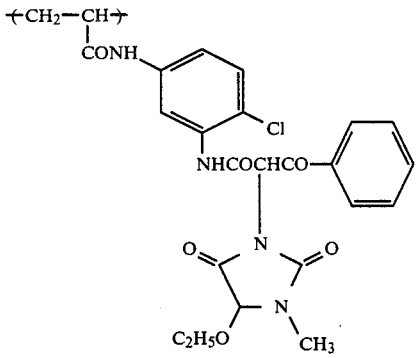

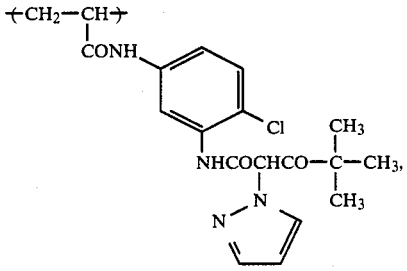

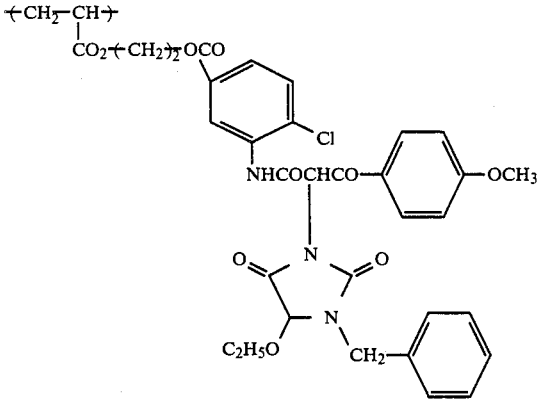

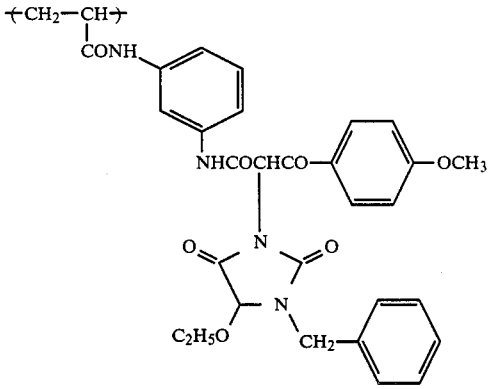

Q in the above-mentioned formula (A) may represent a group derived from a development inhibitor, and examples thereof are described, e.g., in U.S. Pat. Nos. 3,227,554, 3,384,657, 3,615,506, 3,617,291 and 3,733,201, and British Pat. No. 1,450,479. Preferred development inhibitor residues are represented by the following formulae (II)-1 through (II)-6, which are described in Japanese Patent Application (OPI) No. 145135/79.

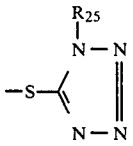

(II) - 1

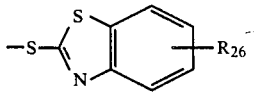

(II) - 2

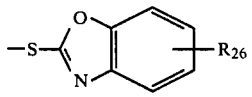

(II) - 3

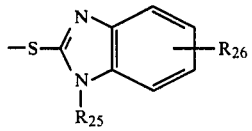

(II) - 4

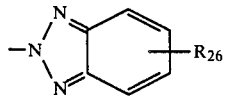

(II) - 5

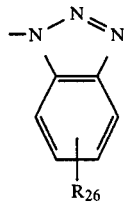

(II) - 6

In the above formulae, $R_{25}$ represents a hydrogen atom, an alkyl group containing from 1 to 6 carbon atoms, phenyl group or a substituted phenyl group; and $R_{26}$ represents hydrogen atom, a halogen atom, an alkyl group containing from 1 to 4 carbon atoms, or nitro group.

Preferred examples of repeating units having a photographically useful group of a development inhibitor residue which are included in the scope of said formula (A) are set forth below.

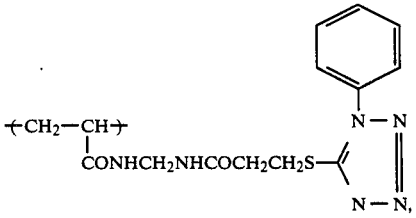

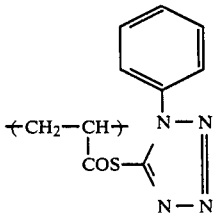

-continued

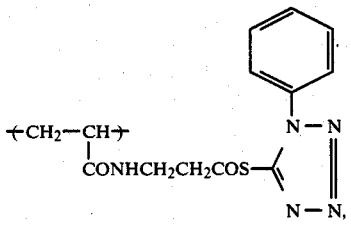

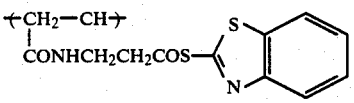

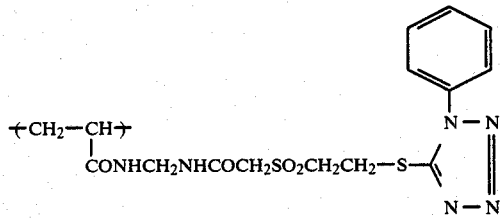

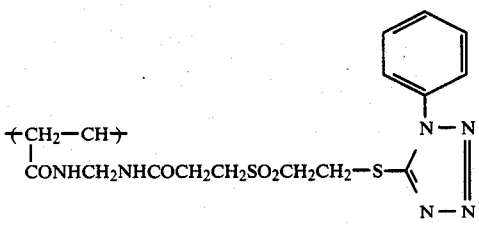

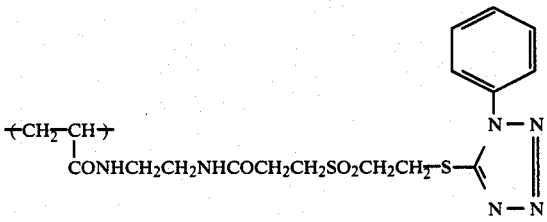

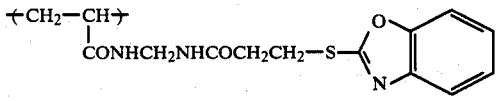

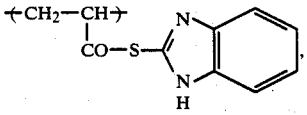

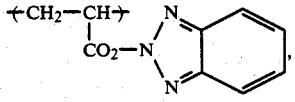

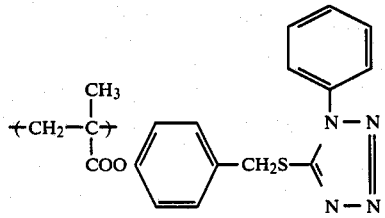

-continued

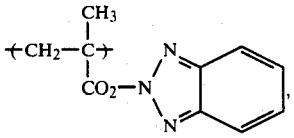

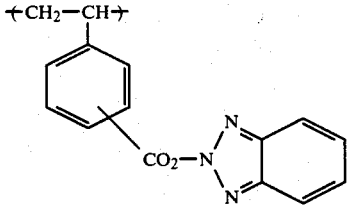

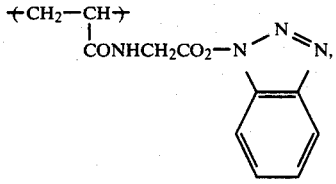

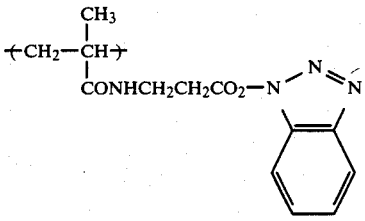

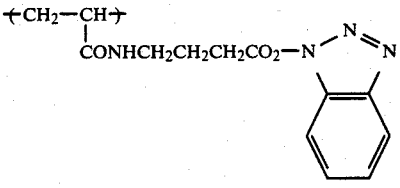

Q in the formula (A) may represent a group derived from a developing agent, and examples thereof are described, e.g., in U.S. Pat. Nos. 2,193,015, 2,108,243, 2,592,364, 3,656,950, 3,658,525, 2,751,297, 2,289,367, 2,772,282, 2,743,279, 2,753,265 and 2,304,953.

Preferred developing agents capable of yielding said group Q are aminophenols, phenylenediamines, hydroquinones, and pyrazolidones as described in Japanese Patent Application (OPI) No. 145135/79, and residues of the following formulae (III)-1 through (III)-6 are especially preferred.

(III) - 1

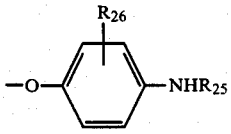

(III) - 2

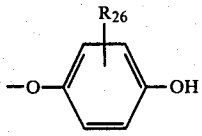

-continued (III) - 3

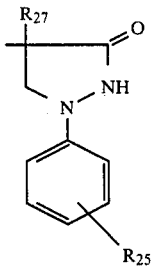

(III) - 4

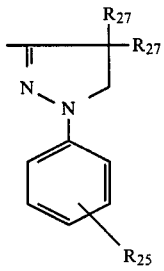

(III) - 5

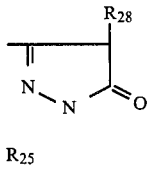

(III) - 6

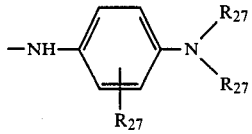

In the above formulae, $R_{25}$ and $R_{26}$ have the same meanings as set forth above; $R_{27}$ represents hydrogen atom, an alkyl group containing 1 to 4 carbon atoms, a hydroxyalkyl group containing from 1 to 4 carbon atoms (such as a hydroxymethyl group or hydroxyethyl group) or a sulfoalkyl group containing from 1 to 4 carbon atoms; and $R_{28}$ represents an alkyl group containing from 1 to 20 carbon atoms or an aryl group containing 6 to 20 carbon atoms.

Preferred examples of repeating units having as a photographically useful group a developing agent group, which are included in the scope of said formula (A) are set forth below.

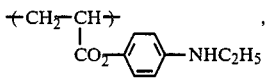

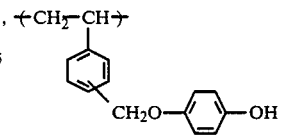

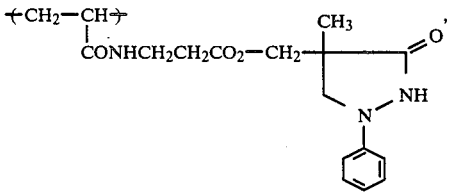

-continued

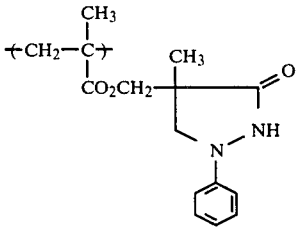

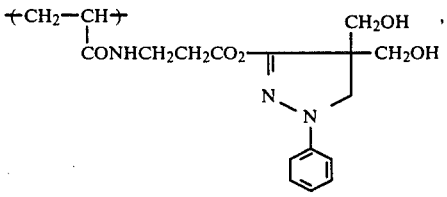

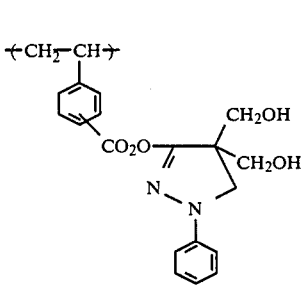

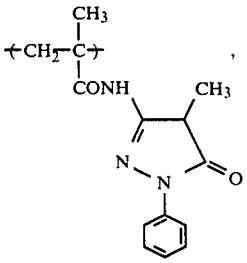

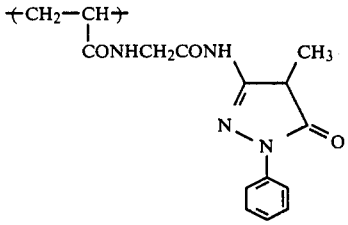

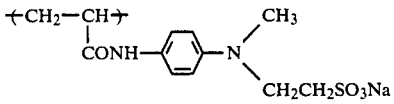

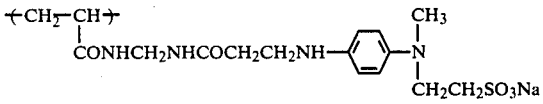

Q in the formula (A) may represent a group derived from a bleaching inhibitor, and examples thereof are described in U.S. Pat. Nos. 3,705,801 and 3,715,208 and German Pat. OLS No. 2,405,279. Groups of the following formulae (IV)-1 through (IV)-4, which are derived from bleaching inhibitors, are especially preferred, as described in Japanese Patent Application (OPI) No. 145135/79.

(IV)-1

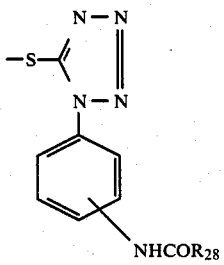

(IV)-2

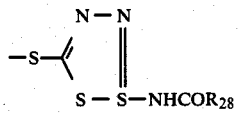

(IV)-3

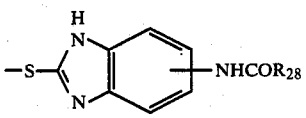

(IV)-4

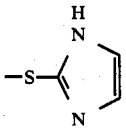

In the above formulae, $R_{28}$ has the same meaning as described above.

Preferred examples examples of repeating units having a photographic group of a bleaching inhibitor group which are included in the scope of said formula (A) are set forth below.

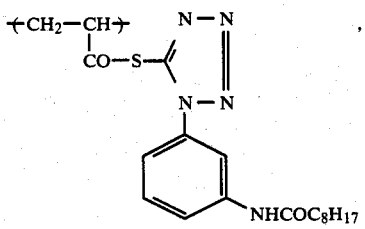

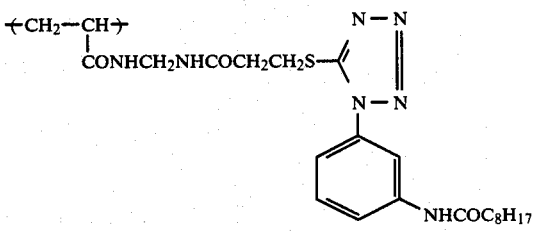

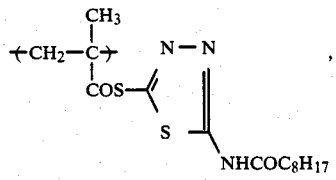

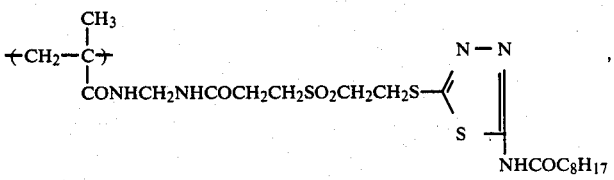

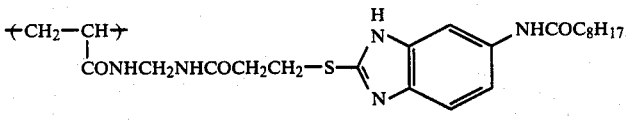

Q in the formula (A) may represent a residue derived from an ultra-violet absorbent, and examples thereof are described, e.g., in U.S. Pat. Nos. 4,431,726, 4,178,303, and 4,207,253, and Japanese Patent Application (OPI) Nos. 178351/83, 185677/83, 111942/83 and 27139/83. Groups of the following formulae (V)-1 through (V)-4, which are derived from ultra-violet absorbents, are especially preferred.

(V)-1

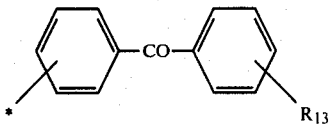

(V)-2

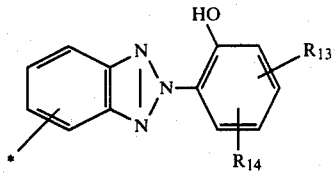

or

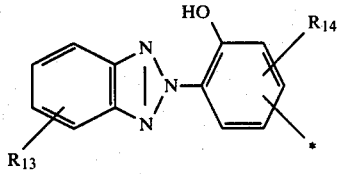

(V)-3

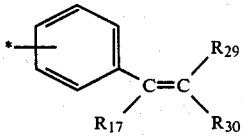

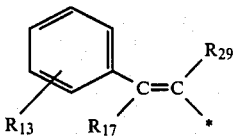

(V)-4

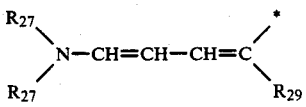

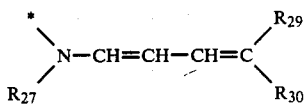

In the above formulae, $R_{13}$, $R_{14}$, $R_{17}$ and $R_{27}$ have the same meanings as described above; $R_{29}$ and $R_{30}$ each independently represents cyano group, an aryl group (such as phenyl group, tolyl group), an alkyl group (such as a methyl group, ethyl group, butyl group, or hexyl group), an alkoxycarbonyl group (such as an ethoxycarbonyl group or propoxycarbonyl group), an arylsulfonyl group (such as a phenylsulfonyl group), or an alkylsulfonyl group (such as a methylsulfonyl group).

Preferred examples of repeating units having as a photographically useful group an ultra-violet absorbent group which are included in the scope of said formula (A) are set forth below.

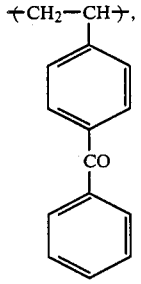

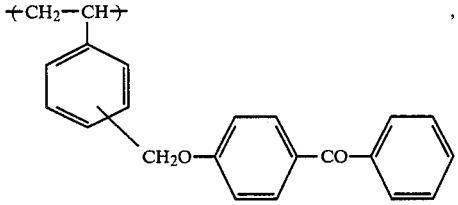

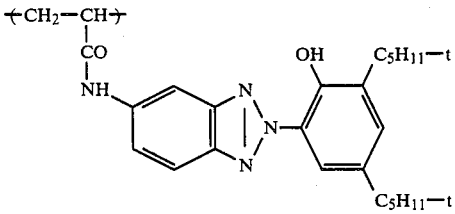

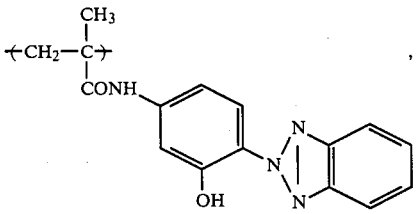

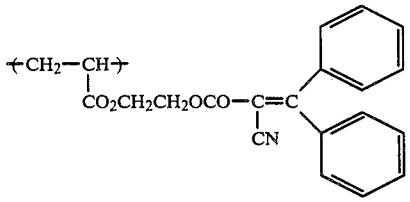

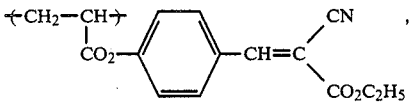

-continued

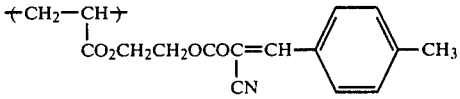

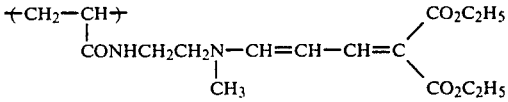

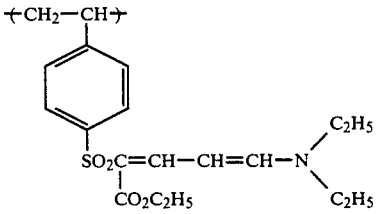

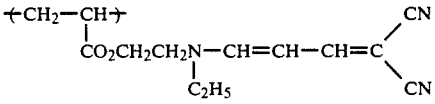

Q in the formula (A) may represent a group derived from a dye, and examples thereof are described in, for example, Japanese Patent Application (OPI) No. 145135/79.

Preferred dyes are triarylmethane-type, azo-type, anthraquinone-type, merocyanine-type, oxonole-type, arylidene-type and styryl-type dyes.

Preferred examples of repeating units having as a photographically useful group a dye group which are included in the scope of said formula (A) are set forth below.

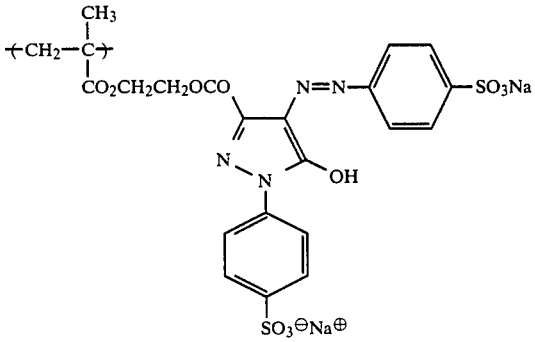

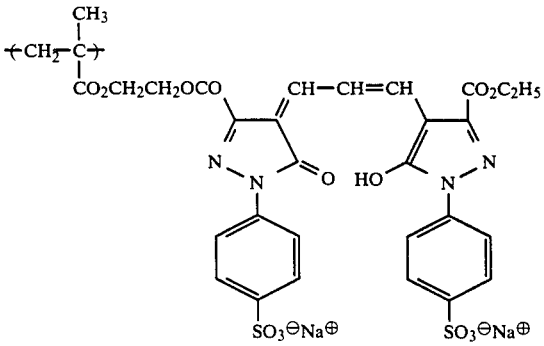

-continued

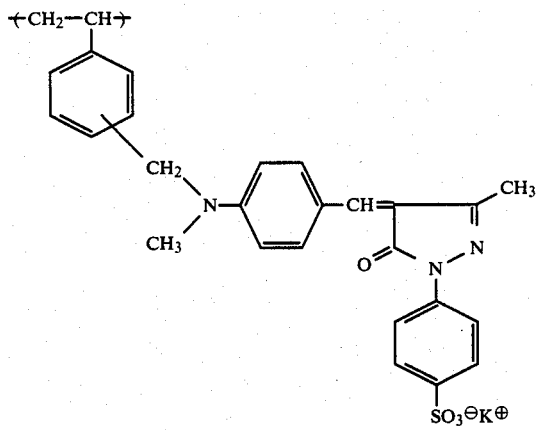

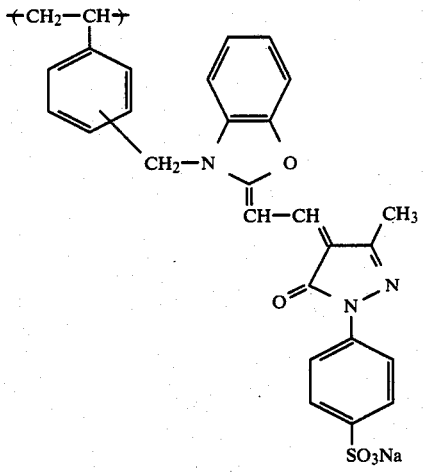

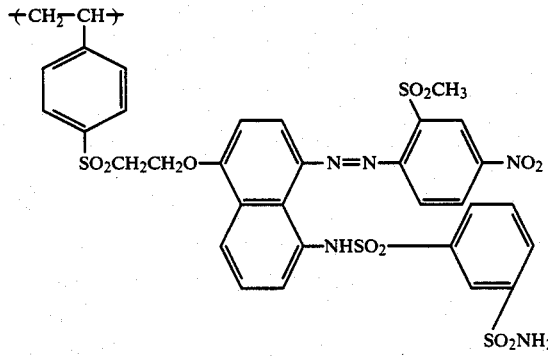

Examples of sulfinic acid group or sulfinate group containing repeating units which may be used in the present invention include those represented by the formula (B)

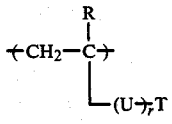

(B)

wherein R has the same meaning as defined in the case of the above-described formula (A); U represents a divalent bonding group containing from 1 to 20 carbon atoms; T represents a sulfinic acid group or a sulfinate group; and r is 0 or 1.

In the repeating units of said formula (B), R is especially preferably a hydrogen atom, methyl group, or ethyl group.

U represents a divalent bonding group having 1 to 20 carbon atoms, for example, an alkylene group (such as a methylene group, ethylene group, trimethylene group, or hexamethylene group), a phenylene group (such as an o-phenylene group, p-phenylene group, or m-phenylene group), an arylene-alkylene group (such as

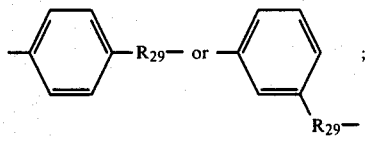

in which $R_{29}$ represents an alkylene group containing from 1 to 12 carbon atoms), $—CO_2—$, $—CO_2—R_{30}—$ (wherein $R_{30}$ represents an alkylene group, group, a phenylene group or an arylenealkylene group), $—CONH—R_{30}—$ (in which $R_{30}$ has the same meaning as above), or

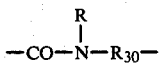

(in which R and $R_{30}$ have the same meanings as described above); and in particular, the following are especially preferred.

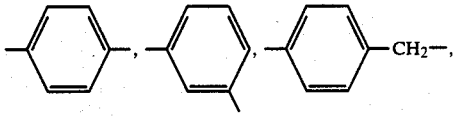

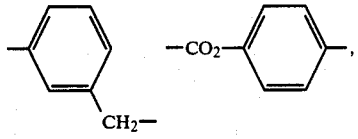

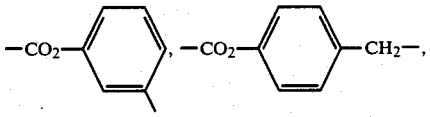

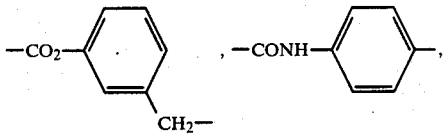

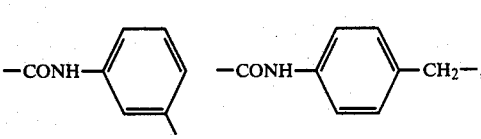

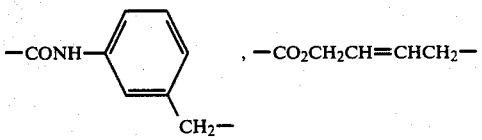

-continued $-CONHCH_2CH{=}CHCH_2-$

T represents a sulfinic acid group or a sulfinate group. The cation to form said sulfinate group is preferably mono- or tri-valent. In case said cation is di-valent or more, the pair anions may comprise any other anion(s) such as $-SO_2^{\ominus}Ba^{2\oplus}Cl^{\ominus}$ or $-SO_2^{\ominus}Al^{3\oplus}Cl_2^{2\ominus}$ in addition to the repeating unit of the formula (B). Preferred cations are ammonium ion and metal ions, and alkali metal ions (such as sodium ion, potassium ion) are especially preferred.

Preferred examples of repeating units of said formula (B) are set forth below.

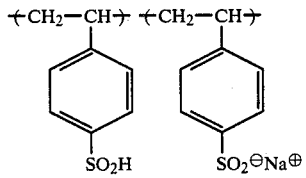

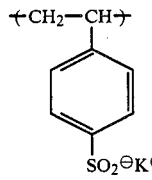

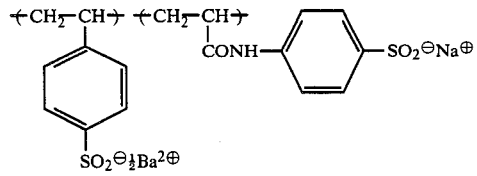

Photographic polymers which may be used in the present invention may additionally contain other repeating units in addition to the photographically useful group-containing repeating unit of the above-described formula (A) and the sulfinic acid group or sulfinate group-containing repeating unit of the above-described formula (B).

Preferred examples of monomers useful for forming said additional repeating units are ethylene, propylene, 1-butnene, 1-vinylimidazole, styrene, sodium vinylbenzenesulfonate, potassium vinylbenzylsulfonate, α-methylstyrene, vinyltoluene, sodium vinylsulfonate; and mono-ethylenic unsaturated esters of fatty acids (such as vinyl acetate, allyl acetate), monoethylenic unsaturated amides of fatty acids (such as N-vinylacetamide, N-vinylpyrrolidone), ethylenic unsaturated mono-carboxylic acid or di-carboxylic acid esters (such as methyl acrylate, ethyl acrylate, hydroxyethyl acrylate, methyl methacrylate, n-butyl methacrylate, benzyl acrylate, 2-ethylhexyl acrylate, cyclohexyl methacrylate, furfuryl acrylate, diethyl maleate, diethyl itaconate), ethylenic unsaturated monocarboxylic acid amides (such as acrylamide, dimethyl-acrylamide, methacrylamide, diacetoneacrylamide, acryloyl-morpholine, sodium acrylamide-2-methylpropane-sulfonate, methacryloyl-morpholine), mono-ethylenic unsaturated compounds (such as acrylonitrile), and dienes (such as butadiene, isoprene); and in particular, highly hydrophilic compounds are especially preferred among them.

In the photographic polymers of the present invention, the content of the photographically useful group-containing repeating unit is preferably from 20 to 98 wt.% and especially preferably from 30 to 90 wt.%; the content of the sulfinic acid group or sulfinate group-containing repeating unit is preferably from 2 to 50 wt.% and more preferably from 4 to 40 wt.%; and the content of other additional repeating unit(s) is preferably 70 wt.% or less.

The polymer couplers of the present invention preferably have a molecular weight of from $5\times10^3$ to $1\times10^7$. If the molecular weight is too small, the polymer is apt to easily move, but on the contrary, if the molecular weight is too large, the polymer is difficult to coat on a photographic support. The preferred molecular weight of the polymers falls within the range of from $1\times10^4$ to $2\times10^6$.

Preferred examples of the polymers which may be used in the present invention are set forth below, with the values set forth beside the parentheses for each type of repeating unit indicating the molar % content thereof.

Examples of cyan coupler group-containing polymers

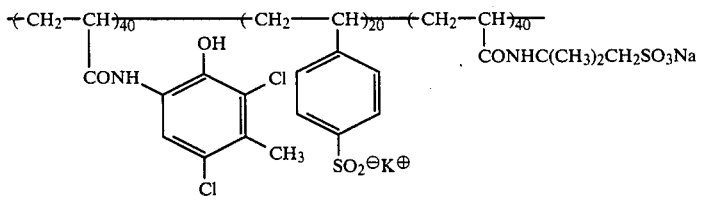

CP-1

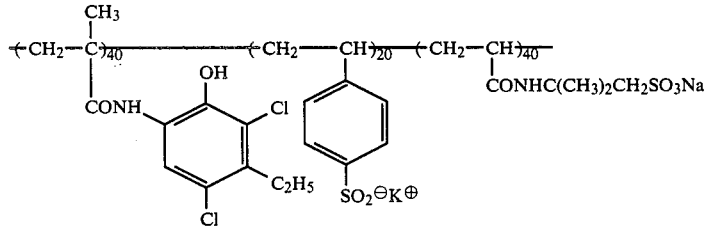

CP-2

-continued
CP-3
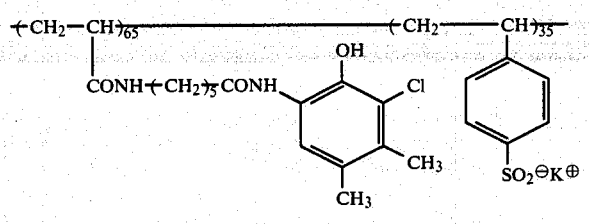
CP-4
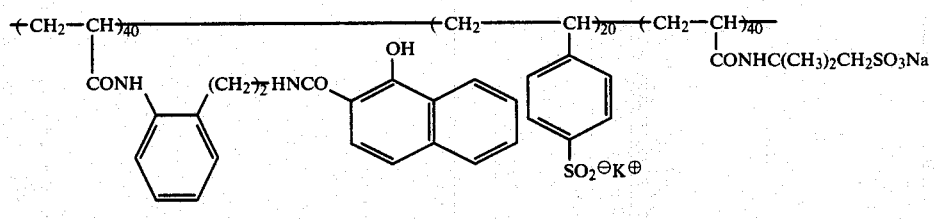
CP-5
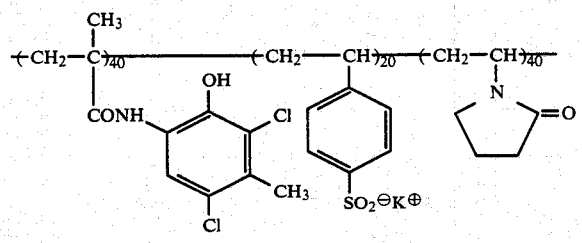
CP-6
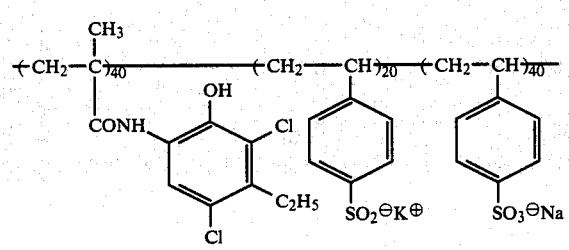
CP-7
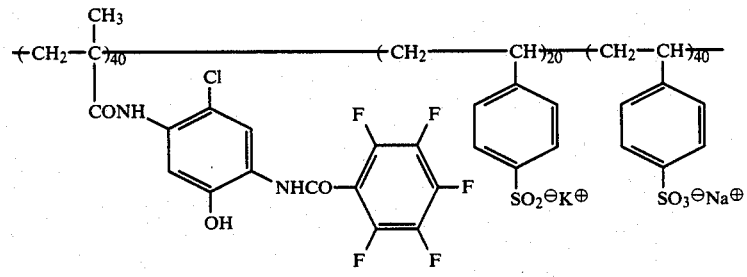
Examples of magenta coupler group-containing polymers
MP-1
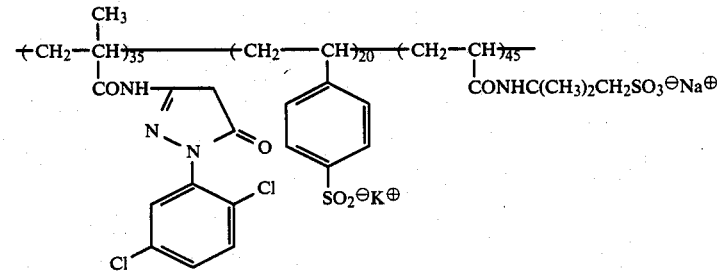

-continued
MP-2
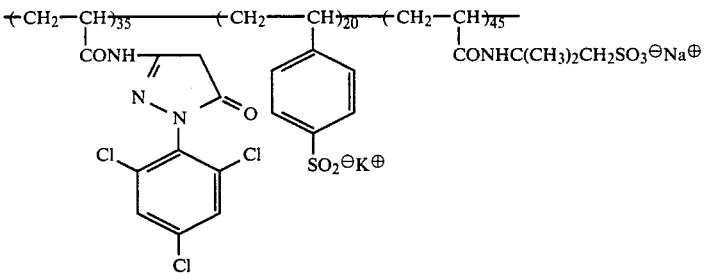
MP-3
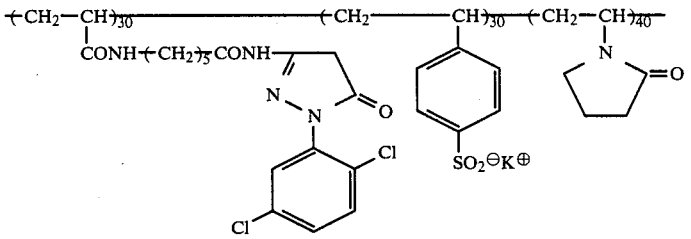
MP-4
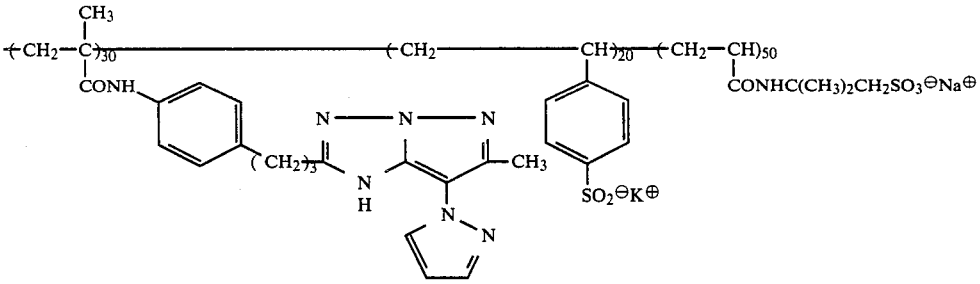
MP-5
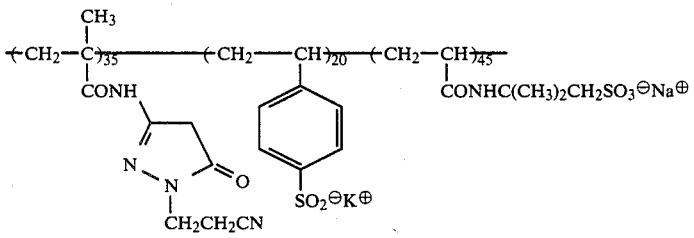
MP-6
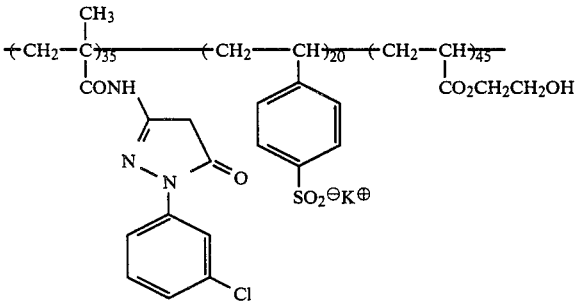

-continued
MP-7
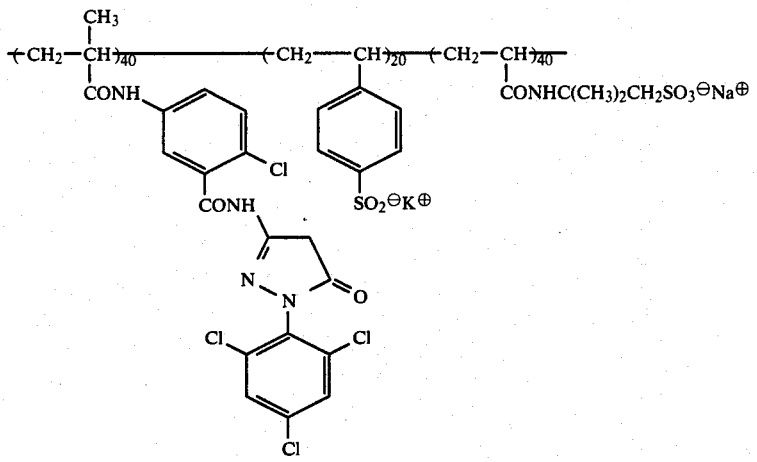
MP-8
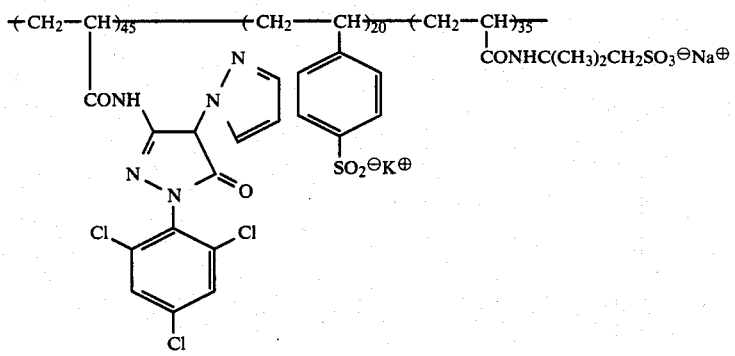
Examples of yellow coupler group-containing polymers
YP-1
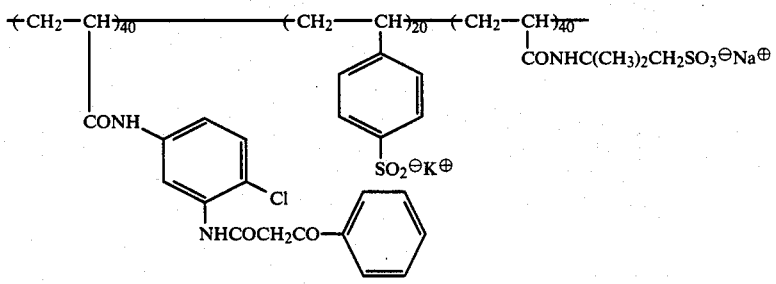
YP-2
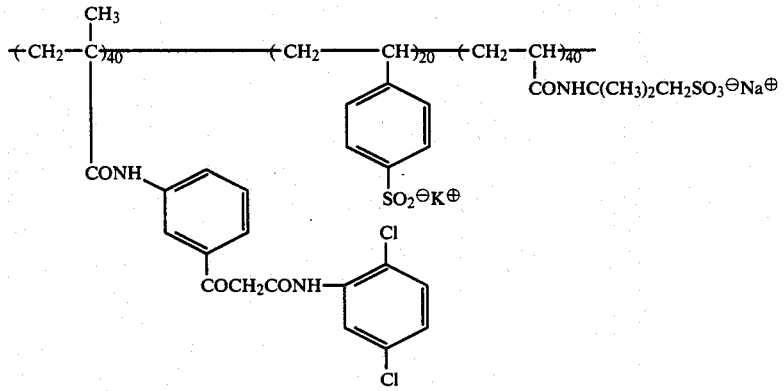

-continued
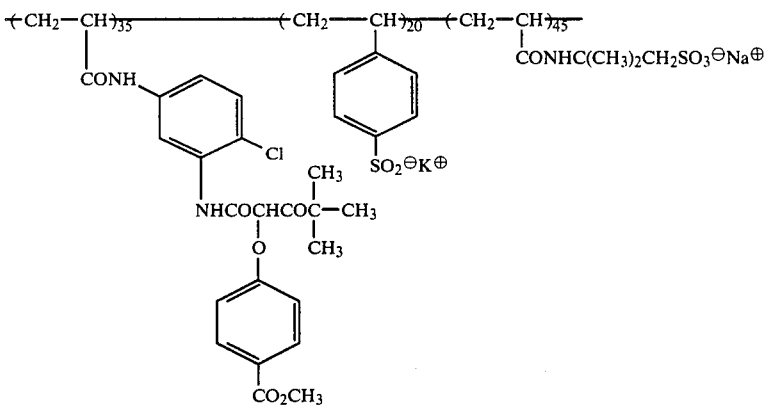
YP-3
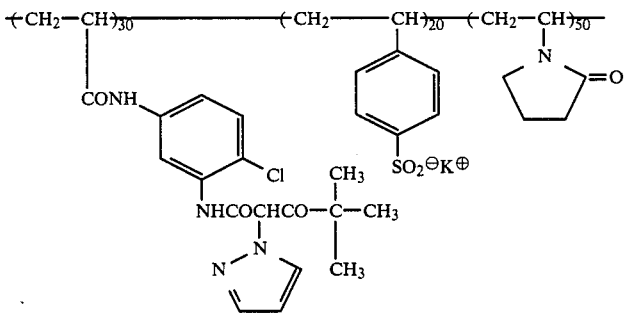
YP-4
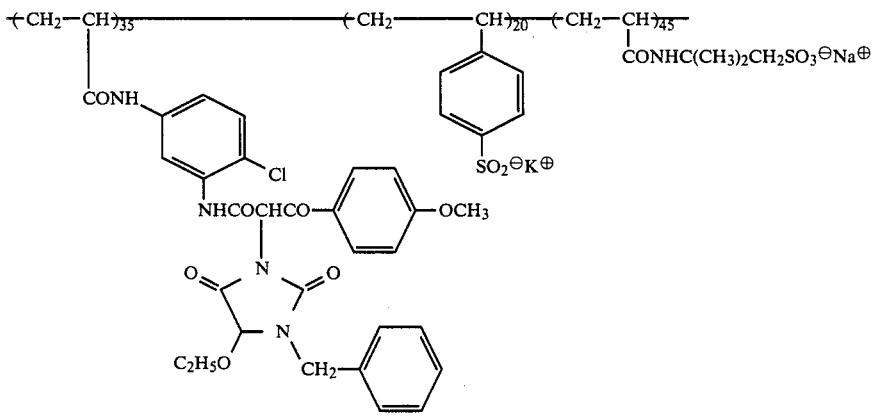
YP-5
Examples of development inhibitor group-containing polymers
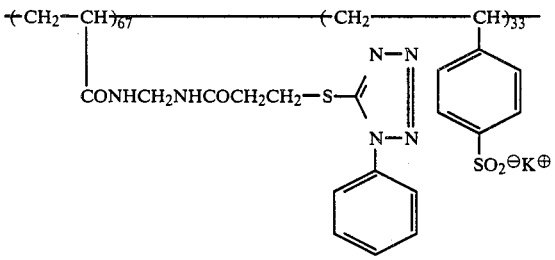
GP-1

-continued
GP-2
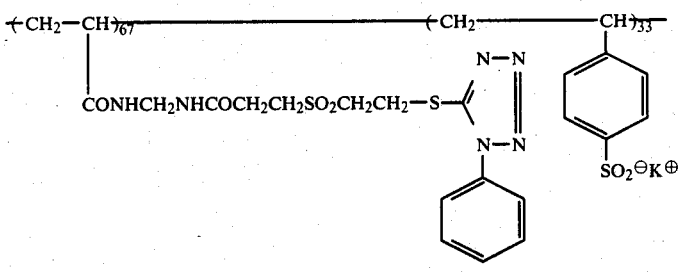
GP-3
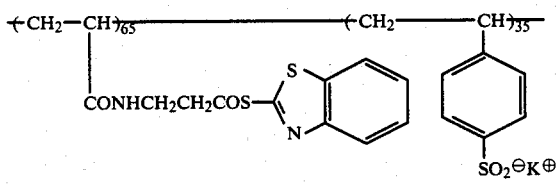
GP-4
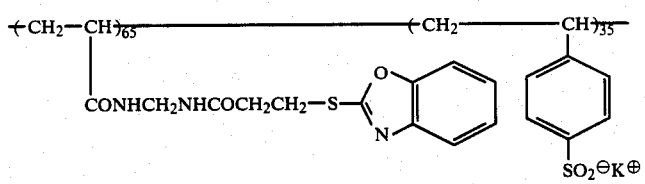
GP-5
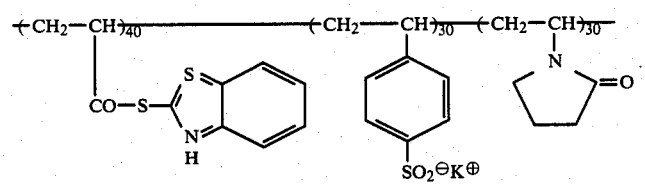
GP-6
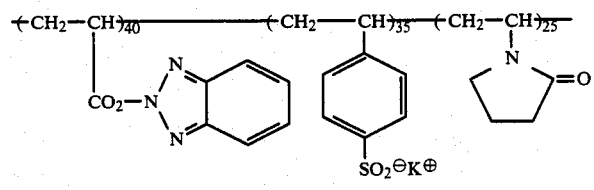
GP-7
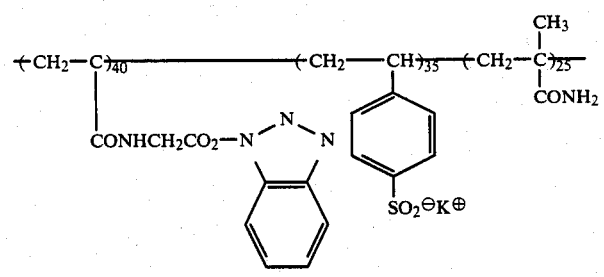
Examples of developing agent group-containing polymers
DP-1
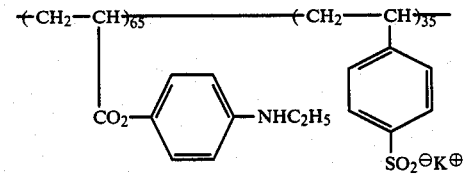

-continued
DP-2
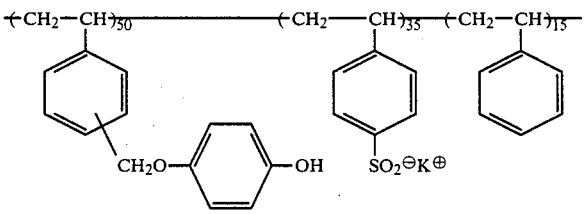
DP-3
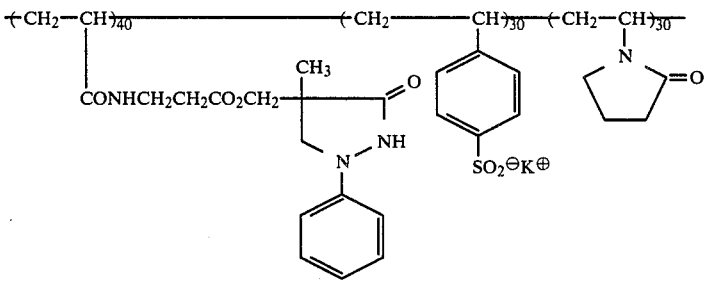
DP-4
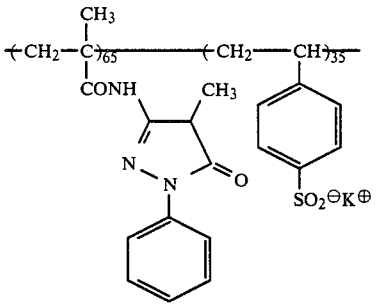
DP-5
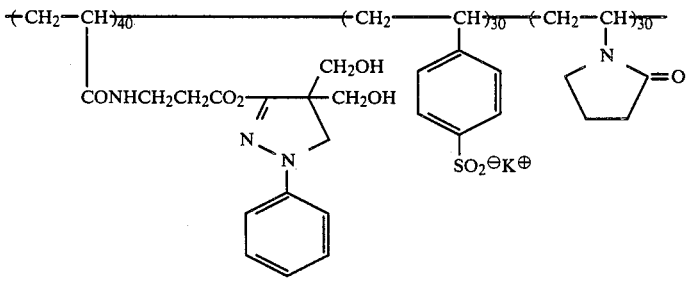
DP-6
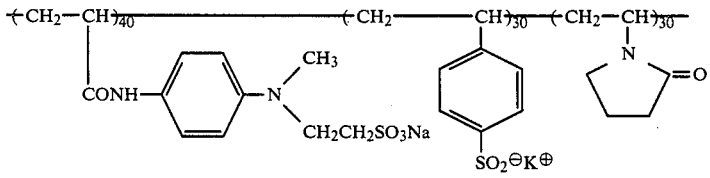
Examples of bleaching inhibitor group-containing polymers
SP-1
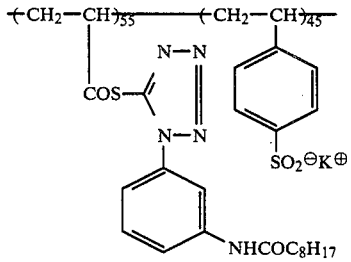

-continued
SP-2
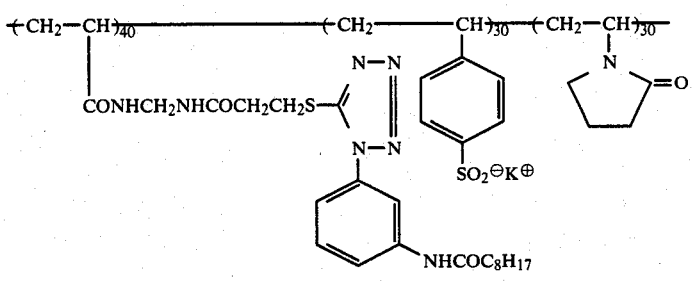
SP-3
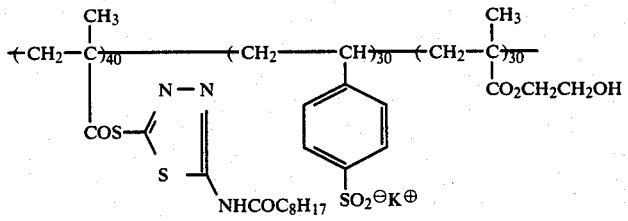
SP-4
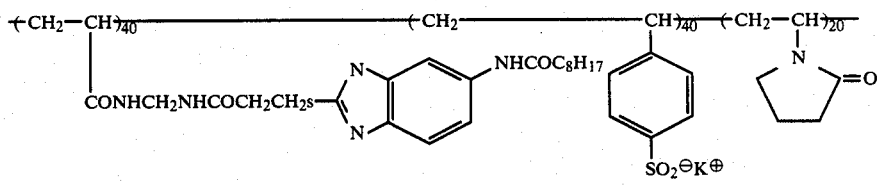
SP-5
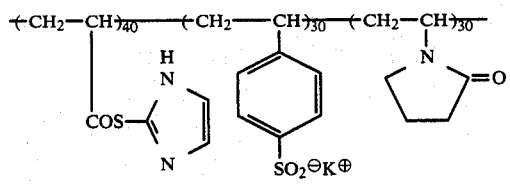
Examples of ultra-violet absorbent group-containing polymers
UP-1
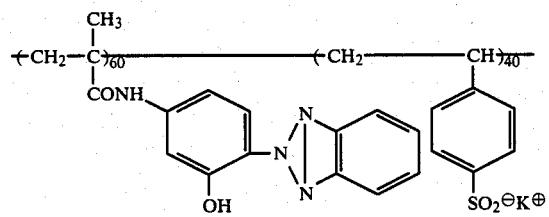
UP-2
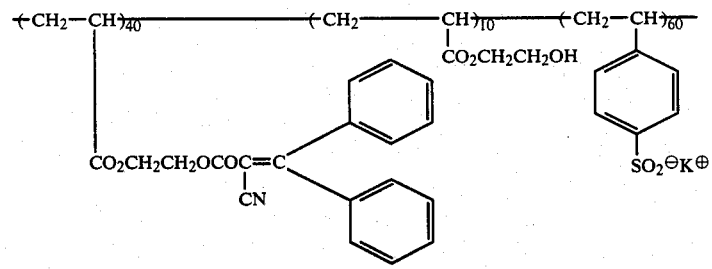
UP-3
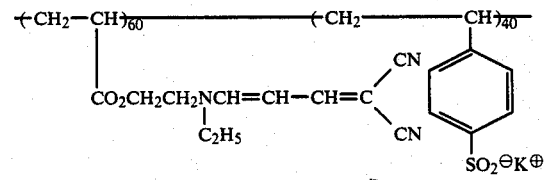

-continued

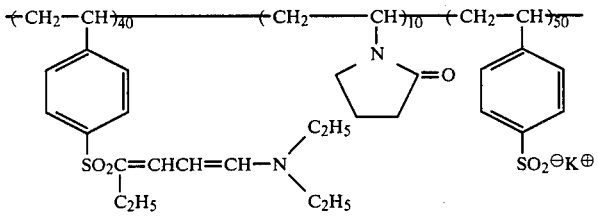

UP-4

Examples of dye group-containing polymers

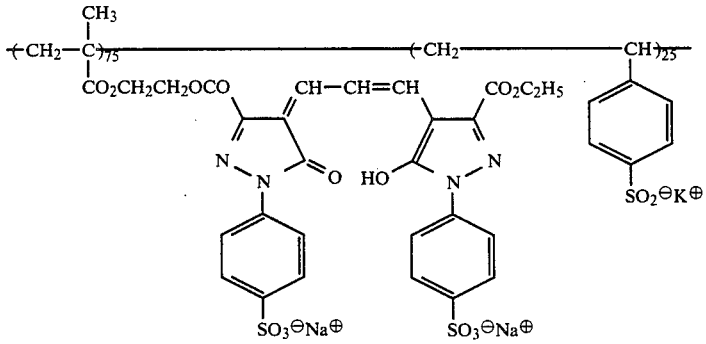

KP-1

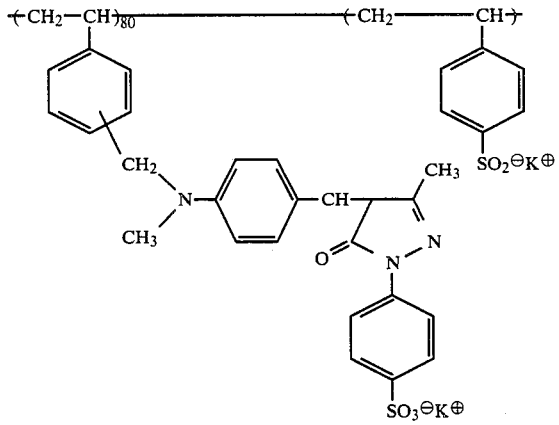

KP-2

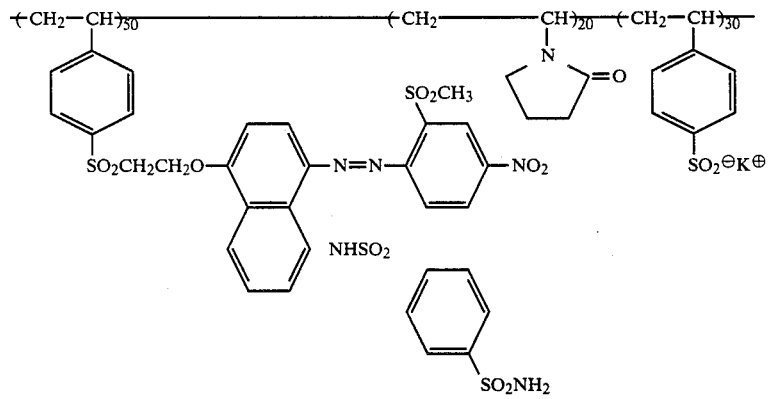

KP-3

As compound (2) which is used in the present invention i.e., a compound having at least one functional group capable of reacting with at least one of a sulfinic acid group and a sulfinate group and at least one other functional group capable of reacting with at least one of a sulfinic acid group, a sulfinate group and a primary amino group, photographic gelatin-hardening agent is preferred.

Preferred photographic gelatin-hardening agents which may be used in the present invention include, for example, an aldehyde (such as formaldehyde, glyoxal, glutaraldehyde), a ketone (such as diacetyl, cyclopentane-dione), an N-methylol compound (such as dimethylol-urea, methylol-dimethylhydantoin), a dioxane derivative (such as 2,3-dihydroxy-dioxane), an active vinyl compound (such as 1,3,5-triacryloyl-hyxahydro-s-triazine, bis(vinylsulfonyl)methylether, N,N'-ethylene-bis(vinylsulfonylacetamide)), an active ester (such as di-N-hydroxysuccinimido-succinate), an active halogen compound (such as 2,4-dichloro-6-hydroxy-s-triazine), a mucohalogenic acid (such as mucochloric acid, mucophenoxychloric acid), an isoxazole, a dialdehyde-starch, a 1-chloro-6-hydroxytriazinylatedgelatin, a high molecular weight active vinyl compound, a high molecular weight active ester compound, etc. Examples of said hardening agents are described, e.g., in U.S. Pat. Nos. 1,870,354, 2,726,162, 2,870,013, 2,893,611, 2,992,109, 3,047,394, 3,057,723, 3,103,437, 3,325,287, 3,362,827, 3,490,911, 3,539,644, and 4,161,407; British Pat. Nos. 676,628, 825,544, and 1,270,578; German Pat. Nos. 872,153, 1,090,427, 2,749,260; Japanese Patent Publication No. 7133/59, and Japanese Patent Application (OPI) Nos. 66841/81 and 142524/81.

Among said gelatin-hardening agents, active vinyl compounds, especially vinylsulfonyl compounds and precursors thereof, are preferred.

Vinysulfonyl compounds which may be used in the present invention include those described, e.g., in Japanese Patent Publication No. 13563/74, U.S. Pat. No. 3,539,664, and *Research Disclosure,* RD No. 17458. Preferred vinylsulfonyl compounds and precursors thereof are represented by the following formulae (C) and (D).

$$(CH_2{=}CH{-}SO_2)_2A \qquad (C)$$

$$(XCH_2CH_2{-}SO_2)_2A \qquad (D)$$

In the above formulae, A represents a divalent bonding group; and X represents a mono-valent organic group which may be removed from the formula (D) in the form of a compound of HX to form a compound of the formula (C).

A is, for example, an alkylene group, preferably having from 1 to 10 carbon atoms, or a phenylene group, and said alkylene group may optionally contain an ether bond or an amido bond in the chain thereof. Said alkylene and phenylene may optionally be substituted with, for example, an alkyl group (preferably having from 1 to 5 carbon atoms, a halogen atom (e.g., chlorine atom), or a hydroxy group. In particular, A is preferably an alkylene group, and especially preferably $-CH_2-$ $-CH_2OCH_2-$, $$-CH_2\underset{\underset{OH}{|}}{C}HCH_2-$$

or $-CH_2CONH-(CH_2)_nNHCOCH_2-$, in which n is 2 or 3.

X is preferably a halogen atom, an acyloxy group (preferably, alkylcarbonyloxy group having from 2 to 4 carbon atoms, and an arylcarbonyloxy group having from 7 to 11 carbon atoms) or a sulfonyloxy group (preferably, an alkylsulfonyloxy group having from 1 to 6 carbon atoms and an arylsulfonyloxy group having from 6 to 10 carbon atoms), and especially preferably a chlorine atom, acetoxy group, or methanesulfonyloxy group.

Examples of preferred gelatin-hardening agents are given belosw, which, however, do not whatsoever restrict the scope of the present invention.

$$CH_2{=}CH{-}SO_2{-}CH_2OCH_2{-}SO_2CH{=}CH_2 \qquad \text{H-1}$$

-continued $$CH_2{=}CH{-}SO_2CH_2SO_2CH{=}CH_2 \qquad \text{H-2}$$

$$CH_2{=}CHSO_2CH_2\underset{\underset{OH}{|}}{C}HCH_2SO_2CH{=}CH_2 \qquad \text{H-3}$$

$$CH_2{=}CHSO_2CH_2CONHCH_2CH_2NHCOCH_2SO_2CH{=}CH_2 \qquad \text{H-4}$$

$$CH_2{=}CHSO_2CH_2CONHCH_2CH_2CH_2NHCOCH_2SO_2CH{=}CH_2 \qquad \text{H-5}$$

$$\left(CH_2{-}\underset{\underset{CONHC(CH_3)_2CH_2SO_3^{\oplus}Na^{\ominus}}{|}}{C}H\right)_{67} \qquad \text{H-6}$$

$$\left(CH_2{-}\underset{\underset{CONHCH_2NHCOCH_2CH_2SO_2CH{=}CH_2}{|}}{C}H\right)_{33}{}^{*}$$

(The figure with an asterisk shows the weight ratio).

The amount of the compound (2) to be used in the present invention may be widely varied, in accordance with the use and the object of the photographic materials to be formed. In general, said amount is from 0.05 to 10 molar times, and preferably from 0.1 to 2.0 molar times, the amount of the sulfinic acid group or the sulfinate group contained in the polymer (1) used in the present invention. When the amount of the compound (2) is too small the fixation of the polymer is not sufficient, on the other hand, when the amount is too large the layer of the photographic material becomes difficult to swell, which prevents impregnation of a processing solution to the layer. Upon deciding the amount of compound (2) the amount which is used for hardening gelatin should also be taken into account.

The polymer (1) and the compound (2) which are used in the present invention are in general incorporated in the same layer; or alternatively may be incorporated in different photographic layers. In the latter case, one compound diffuses into a layer containing the other compound, and as a result, the two compounds come to exist in the same layer. Incorporation of the compounds in different layers is preferably applied in the case that, if both of the compounds used in the present invention were to be added in one coating solution, the viscosity of said coating solution would increase too much and the coating solution is difficult to handle.

Some examples to illustrate the synthesis of polymers which may be used in the present invention are described below.

SYNTHESIS EXAMPLE 1

Synthesis of poly(2'[(1-hydroxy-2-naphthoylamino)ethyl]acrylanidido-co-potassium-p-vinylbenzenesulfinate-co-sodium 2-acrylamido-2-methylpropanesulfonate) (CP-4)

14.0 g of 2'[(1-hydroxy-2-naphthoylamino)ethyl] acryanilide, 7.0 g of potassium p-vinylbenzenesulfinate, 12.6 g of 2-acrylamido-2-methylpropanesulfonic acid, 60 ml of DMF, 60 ml of methanol and 12 ml of 5N-sodium hydroxide aqueous solution were put in a reaction container having a capacity of 300 ml, and the content was fully purged by the use of nitrogen gas. Afterwards, the whole was heated at 60° C., and then 0.175 g of 2,2'-azobisisobutyronitrile was added thereto and continuously heated for 4 hours. The reaction sample was cooled to room temperature and then put in 600 ml of acetone. Thus crystallized precipitate was separated by filtration, and then dried in vacuum, to obtain 21.6 g of the desired polymer. Yield: 62%.

SYNTHESIS EXAMPLE 2

Synthesis of
poly(1-(2,5-dichlorophenyl)-3-methacryloylamino-2-pyrazolin-5-one-co-potassium p-vinylbenzenesulfinate-co-sodium 2-acrylamido-2-methylpropanesulfonate) (MP-1)

10.5 g of 1-(2,5-dichlorophenyl)-3-methacryloylamino-2-pyrazolin-5-one, 6.0 g of potassium p-vinylbenzenesulfinate, 13.5 g of 2-acrylamido-2-methylpropanesulfonic acid, 60 ml of DMF, 60 ml of methanol and 14 ml of 5N-sodium hydroxide aqueous solution were put in a reaction container having a capacity of 300 ml, and the content was fully purged by the use of nitrogen gas. Afterwards, the whole was heated at 60° C., and then 0.15 g of 2,2'-azobisisobutyronitrile was added thereto and continuously heated for 4 hours. The reaction sample was cooled to room temperature and then put in 600 ml of acetone. Thus crystallized precipitate was separated by filtration and then dried in vacuum, to obtain 15.5 g of the desired polymer. Yield: 49%.

SYNTHESIS EXAMPLE 3

Synthesis of
poly(1-(2,4,6-trichlorophenyl)-3-(2-chloro-3-acrylamidobenzamido)-2-pyrazolin-5-one-co-potassium p-vinylbenzenesulfinate-co-sodium 2-acrylamido-2methylpropanesulfonate) (MP-7)

The above entitled polymer was synthesized analogously to the synthesis Example 2, using 1-(2,4,6-trichlorophenyl)-3-(2-chloro-3-acrylamidobenzamido)-2-pyrazoline-5-one. Yield: 53%.

SYNTHESIS EXAMPLE 4

Synthesis of
poly(4'-chloro-3'-[α-(4-methoxycarbonylphenoxy)-α-pivaloylacetamido]acrylanilido-co-potassium p-vinylbenzenesulfinate-co-sodium 2-acrylamido-2-methylpropanesulfonate) (YP-3)

10.5 g of 4'-chloro-3'-[α-(4-methoxycarbonylphenoxy)-α-pivaloylacetamido]acrylanilide, 6.0 g of potassium p-vinylbenzenesulfinate, 13.5 g of 2-acrylamido-2-methylpropane-sulfonic acid, 60 ml of DMF, 60 ml of methanol and 14 ml of 5N-sodium hydroxide were put in a reaction container having a capacity of 300 ml, and the content was fully purged by the use of nitrogen gas. Afterwards, the whole was heated at 60° C., and then 0.15 g of 2,2'-azobisisobutyronitrile was added thereto and continuously heated for 4 hours. The reaction sample was cooled to room temperature and then put in 600 ml of acetone. Thus crystallized precipitate was separated by filtration and then dried in vacuum, to obtain 17.2 g of the desired polymer. Yield: 55%.

SYNTHESIS EXAMPLE 5

Synthesis of
poly(3-methacryloylamino-4-methyl-2-pyrazolin-5-one-co-potassium p-vinylbenzenesulfinate) (DP-4)

23.4 g of 3-methacryloylamino-4-methyl-2-pyrazolin-5-one, 10.1 g of potassium p-vinylbenzenesulfinate, 70 ml of DMF and 60 ml of methanol were put in a reaction container having a capacity of 300 ml, and the content was fully purged by the use of nitrogen gas. Afterwards, the whole was heated at 60° C., and then 0.23 g of 2,2'-azobisisobutyronitrile was added thereto and continuously heated for 4 hours. The reaction sample was cooled to room temperature and then put in 800 ml of acetone. Thus crystallized precipitate was separated by filtration and then dried in vacuum, to obtain 20.4 g of the above-entitled polymer. Yield: 61%.

The compounds of the present invention may be incorporated in the same one layer in the form of a mixture of two or more kinds of said compounds. Also, a particular compound may be incorporated in two or more different layers.

The polymer (1) and the compound (2) may be incorporated in any layer of a photographic material, such as, a silver halide emulsion layer, a protective layer, an interlayer, and a subbing layer depending on the aim of use of the polymer.

For introduction of the polymer (1) and the compound (2) of the present invention into silver halide emulsion layers, water-soluble compounds among said compounds may be incorporated in a silver halide emulsion in the form of an aqueous solution thereof; water-insoluble compounds may be dispersed in a hydrophilic colloid and the resulting dispersion incorporated in a silver halide emulsion. The polymer (1) and the compound (2) may be incorporated separately. The silver halide emulsion thus containing the compounds of the present invention is thereafter coated on a photographic support. In the same manner the compounds can be incorporated to other layers. Furthermore, the compound (2) may be impregnated to a photographic material as a solution after completion of coating of all layers.

The amount of the polymer (1) to be used in the present invention is determined, depending upon the property and the use of the photographic material to be formed, for example, upon the layer to which the polymer is to be added, the kind of compounds to be co-used, and the means for treating the photographic material.

The silver halide photographic materials of the present invention may be applied to color negative films, color reversal films, color positive film, color photographic papers, color reversal photographic papers or a color diffusion transfer-system or silver dye bleaching-system color photographic materials. The materials may also be applied to black and white photographic materials such as black and white photographic films, X-ray films, photo-engraving films, black and white photographic papers, aerial photographic films, microfilms, facsmimile films phototypesetting films, photographic papers, graphic films, etc.

Gelatins which may be used in the silver halide photographic materials of the present invention may be a so-called alkali-treated (or lime-treated gelatin, which is dipped in an alkaline bath, prior to the extraction of gelatin, in the manufacture procedure thereof, or an acid-treated gelatin, which is dipped in an acidic bath, or a double-dipped gelatin, which is subject to said both alkali and acid treatments; or, it may also be an enzyme-treated gelatin, as described in "Bull, Soc. Sci. Photo, Japan", No. 16, page 30 (1966). In addition, partially hydrolyzed gelatins having a low molecular weight which is obtained by heating the above-mentioned various kinds of gelatins in a hot-water bath or reacting those with a protease may also be used in the present invention.

The above-described gelatins, to which the compounds of the present invention may be applied, may optionally be partially substituted by a collodial albumin, a casein, a cellulose derivative such as carboxymethylcellulose or hydroxyethylcellulose, an agar, a sodium alginate, a saccharide derivative such as starch derivative, a synthetic hydrophilic colloid such as polyvinyl alcohol, poly-N-vinylpyrrolidone, polyacrylic acid co-polymer or polyacrylamide, or a derivative thereof or a partially hydrolyzed product thereof; or otherwise may also optionally be partially substituted by a gelatin derivative obtained by modification of functional amino, imino, hydroxyl and/or carboxyl group(s) contained in the gelatin molecule with a reagent having one reactive group capable of reacting with said functional groups, or by a gelatin-graft polymer obtained by graft-polymerization of gelatin with other high molecular substance.

Examples of reagents which may be used for formation of said gelatin derivatives are, for example, isocyanates, acid chlorides, and acid anhydrides as described in U.S. Pat. No. 2,614,928; acid anhydrides as described in U.S. Pat. No. 3,118,766; bromoacetic acids as described in Japanese Patent Publication No. 5514/64; phenylgylcidylethers as described in Japanaese Patent Publication No. 26845/67; vinylsulfone compounds as described in U.S. Pat. No. 3,132,945; N-allylvinylsulfonamides as described in British Pat. No. 861,414; malemide compounds as described in U.S. Pat. No. 3,186,846; acrylonitriles as described in U.S. Pat. No. 2,594,293; polyalkyleneoxides as described in U.S. Pat. No. 3,312,553; epoxy compounds as described in Japanese Patent Publication No. 26845/67; acid esters as described in U.S. Pat. No. 2,763,639; and alkanesultones as described in British Pat. No. 1,033,189.

A number of high molecular weight substances which may be grafted with gelatin, are known, and described e.g., in U.S. Pat. Nos. 2,763,625, 2,831,767, and 2,956,884; *Polymer Letters,* Vol. 5, p. 595 (1967); *Phot. Sci. Eng.,* Vol. 9, p. 148 (1965); *J. Polymer Sci.,* A-1, Vol. 9, p. 3199 (1971), etc. For example, polymers and copolymers of so-called vinyl monomers such as acrylic acid, methacrylic acid or an ester, amide or nitrile derivative thereof, or styrene, may be used for said graft-polymerization. In particular, hydrophilic vinyl polymers or copolymers which are somewhat compatible with gelatin are especially preferred, including polymers or copolymers of acrylic acid, acrylamide, methacrylamide, hydroxy-alkyl acrylate, hydroxylalkyl methacrylate, etc.

The photographic materials of the present invention may optionally contain, in the photographic emulsion layers or other layers thereof, synthetic polymers other than the above-described polymers, such as a water-dispersible vinyl-polymer in the form of a latex, especially preferably a compound capable of increasing the dimensional stability of the photographic material, singly or in the form of a mixture of said compounds, or, if necessary, in the form of a combination of said compound with other hydrophilic water-permeable colloid.

The photographic materials of the present invention may further contain a matting agent. Fine particles of a water-insoluble organic or inorganic compound are preferred as said matting agent, having an average diameter of from 0.2 to 10 μm, and especially preferably from 0.3 to 5 μm.

In the case wherein the photographically useful group-containing polymer to be used in the present invention is a yellow polymer-coupler, this coupler is in general incorporated in a blue-sensitive emulsion layer; in the case wherein the coupler is a magenta polymer-coupler, it is generally incorporated in a green-sensitive emulsion layer; and in the case wherein the coupler is a cyan polymer-coupler, it is generally incorporated in a red-sensitive emulsion layer. However, different combinations than those mentioned above may also be used, if desired. Couplers other than the polymer-couplers of the present invention may analogously be incorporated in an appropriate emulsion layer, if co-used. Examples of other couplers than the polymer-couplers of the present invention, which may be co-used together with the present polymer-couplers, are polymer-couplers which do not contain any monomer unit represented by the above-described formula (B) as well as polymer-couplers represented by the above-described formulae (I)-1 through (I)-17 in which the position marked with an asterisk (*) is bound to a substituent of $R_1$ as defined in the formula (I)-1.

Said couplers may be either 4-equivalent or 2-equivalent to silver ion. In addition, they may also be colored couplers having a color-correcting activity, or so-called DIR-couplers which may release a development inhibitor during development.

Besides said DIR coulers, a non-coloring DIR-coupling compound may be included, which may form a colorless reaction product after coupling and which may release a development inhibitor during development. Compounds other than said DIR-couplers may also be used which may release a development inhibitor during development.

For introduction of the coupler in a silver halide emulsion layer in the present invention, a known method may be used, for example, as described in U.S. Pat. No. 2,322,027. For instance, the coupler to be incorporated in a silver halide emulsion layer is first dissolved in an alkyl phthalate (such as dibutyl phthalate, dioctyl phthalate), a phosphate (such as diphenyl phosphate, triphenyl phosphate, tricresyl phosphate, dioctylbutyl phosphate), a citrate (such as tributyl acetylcitrate), a benzoate (such as octyl benzoate), an alkylamide (such as diethyllaurylamide), a fatty acid ester (such as dibutoxyethyl succinate, diethyl azelate), a trimesate (such as tributyl trimesate); or in an organic solvent having a boiling point of about 30°-150° C., for example, a lower alkyl acetate (such as ethyl acetate, butyl acetate), ethyl propionate, secondary butyl alcohol, methylisobutylketone, β-ethoxyethyl acetate, methylcellosolve, etc.; and then the resulting solution is dispersed in a hydrophilic colloid. Said high boiling point-organic solvent and low boiling point-organic solvent may be used together in the form of a mixture thereof.

Apart from said method, another dispersion method by the use of a polymer substance may also be used for the introduction of the coupler, e.g., as described in Japanese Patent Publication No. 39853/76 and Japanese Patent Application (OPI) No. 59943/76.

In the case that the coupler has an acid group such as a carboxylic acid or sulfonic acid group said coupler may be introduced in a hydrophilic colloid in the form of an alkaline aqueous solution thereof.

The photographic emulsion layer of the photographic materials of the present invention may contain any silver halide selected from silver bromide, silver bromoiodide, silver chloroiodide, silver bromochloride, and silver chloride.

The average particle size of silver halide particles in the photographic emulsion in the present invention is not specifically limitative, but is preferably 3μ or less. Regarding the average particle size of silver halide particles, in the case of particles that are spherical or nearly spherical, the diameter of the particle is measured on the basis of the projected area thereof, and in case the particles are cubical, the length of the side is measured also on the basis of the projected area thereof, and the size is designated by the average of the measured values.

The particle size distribution may be broad or narrow.

The silver halide particles in the photographic emulsion of the present invention may have a regular crystalline form such as a hexahedrom or octahedron form; or otherwise may have an irregular crystalline form such as a spherical or plate-like form; or in addition, may have a composite crystalline form compising the combination of said regular and irregular forms. Moreover, these silver halide particles may comprise a mixture of various crystalline forms.

An emulsion containing ultra-flat plate-like silver halide particles, in which the diameter of the particle is larger than the thickness thereof by 5 times or more, in a proportion of 50% or more of the total projected area, may also be used in the photographic materials of the present invention.

The silver halide particles of the present invention may have different inner phase and surface layer phase. Said particles may form a latent image mainly on the surface parts thereof, or otherwise, may form the same mainly in the inner parts thereof.

The photographic emulsions to be used in the present invention may be prepared according to conventional methods as described in *Chimie et Physique Photographique,* by P. Glafkides, Paul Montel Co., (1967); *Photographic Emulsion Chemistry,* by G. F. Duffin, The Focal Press Co. (1966); or *Making and Coating Photographic Emulsion,* by V. L. Zelikman, et al., The Focal Press Co., (1964). The preparation of the present photographic emulsions may be carried out by any of acid method, neutral method, or ammonia method, according to said conventional means. In a reaction system where a soluble silver salt is reacted with a soluble halide, any conventional means such as one-side admixture method, simultaneous admixture method or a combination of said methods may be utilized.

A so-called reverse-admixture method may also be used, where silver halide particles are formed in the presence of an excess silver ion. As one embodiment of the simultaneous admixture method, a so-called controlled-double jet method may be used, where the pAg value in the liquid phase necessary to form silver halide particles is determined, and kept at the determined value. According to said method, a silver halide emulsion comprising particles having a regular crystalline form and a uniform particle size may be obtained.

Two or more kinds of silver halide emulsions which have been prepared separately may be used together in the form of a mixture thereof.

During the formation of silver halide particles or during the physical ripening step thereof, a cadmium salt, a zinc salt, a lead salt, a thallium salt, an iridium salt or a complex salt thereof, a rhodium salt or a complex salt thereof, or an iron salt or a complex salt thereof may co-exist in the reaction system.

Silver halide emulsions are in general chemical-sensitized. For the chemical-sensitization, for example, methods as described in *Die Grundlagender Photographischen Processe mit Silberhalogeniden,* by H. Freiser, Akademische Verlagsgessellshaft, (1968), pp 675–734, may be used.

More precisely, a sulfur-sensitization method where a sulfur-containing compound capable of reacting with an active gelatin is used; a reductive sensitization method using a reductive substance; and a noble metal-sensitization method using a noble metal compound may be used for the chemical-sensitization of the silver halide emulsions of the present invention, and said methods may be carried out singly or in the combination of two or more methods.

The photographic emulsions to be used in the present invention may additionally contain various kinds of additives, in order to prevent the photographic materials from being fogged during the manufacture thereof or during the preservation or photographic treatment thereof, or to stabilize the photographic characteristics of said materials.

For example, various kinds of conventional compounds which are known as anti-fogging agents or as stabilizers may be added to the present photographic emulsions, such as an azole compound, a mercaptopyrimidine compound, a mercaptotriazine compound, a thiocarbonyl compound, an azaindene compound, a thiosulfonic acid compund, a sulfinic acid compound, and a sulfonamide compound.

The photographic materials of the present invention may contain, in the photographic emulsion layer or in other hydrophilic colloid layer, a coating auxiliary and various kinds of surfactants, for the purpose of static charge prevention, improvement of slide property, emulsification and dispersion, blocking inhibition, and improvement of photographic characteristics (e.g., development acceleration, high contrast reproduction, and sensitization).

For instance, various kinds of surfactants may be used for said purpose, including non-ionic surfactants such as saponins (steroid type), alkyleneoxide derivatives, glycidol derivatives, fatty acid esters of polyhydric alcohols and alkylesters of saccharides; anionic surfactants containing an acid group such as carboxyl group or sulfo group; ampholytic surfactants such as aminoalkylsulfinic acid and alkylbetains; and cationic surfactants such as alkylamine salts and quaternary ammonium salts.

The photographlic emulsion layer of the present photographic materials may further contain other additives for the purpose of increasing sensitivity and contrast, and for acceleration of development, including polyalkyleneoxides and ester, ether and amine derivatives thereof, and thioether compounds, thiomorpholines, quaternary ammonium salt compounds, urethane derivatives, urea derivatives, imidazole derivatives and 3-pyrazolidone derivatives.

The present photograhic materials may contain, in the photographic emulsion layer or in other hydrophilic colloid layer, a dispersion of a synthetic polymer which is insoluble or hardly soluble in water, for the purpose of improvement of dimension stability. For example, polymers or copolymers of an alkyl (meth)acrylate and/or (meth)acrylamide and/or styrene, optionally with a (meth)acrylic acid, hydroxyalkyl (meth)acrylate and/or styrenesulfonic acid, may be used for said purpose.

The photographic emulsions to be used in the present invention may be spectral-sensitized by the use of methine dyes or the like other dyes. Examples of dyes which may be used for said spectral-sensitization are cyanine dyes, merocyanine dyes, complex cyanine dyes, complex merocyanine dyes, holopolar cyanine dyes, hemicyanine dyes, styryl dyes and hemioxonol dyes. Especially preferred dyes among them are cyanine dyes, merocyanine dyes and complex merocyanine dyes. These dyes may have any basic heterocyclic nucleus which is conventionally contained in cyanine dyes; including pyrroline, oxazoline, thiazoline, pyrrole, oxazole, thiazole, selenazole, imidazole, tetrazole and pyridine nuclei; fused nuclei comprising said nucleus and an alicyclic hydrocarbon ring; and fused nuclei comprising said nucleus and an aromatic hydrocarbon ring, such as indolenine, benzindolenine, indole, benzoxazole, napthoxazole, benzothiazole, naphthothiazole, benzoselenazole, benzimidazole and quinoline nuclei. These nuclei may be substituted on carbon atoms.

Merocyanine dyes and complex merocyanine dyes may contain a ketomethylene structure-containing 5 or 6 membered heterocyclic ring nucleus such as pyrazolin-5-one, thiohydantoin, 2-thiooxazolidine-2,4-dione, thiazolidine-2,4-dione, rhodanine, and thio-barbituric acid nuclei.

These sensitizing dyes may be used singly or in the form of a mixture thereof, and the use of a combination of sensitizing dyes is often preferred for the purpose of supersensitization.

The present photographic emulsion may further contain other dyes which themselves have no spectral-sensitization activity, or other substances which do not substantially absorb any visible radiation, but have supersensitization activity, together with the above-mentioned sensitizing dyes. For example, amino-styryl compounds which are substituted by an nitrogen-containing heterocyclic ring group (e.g., as described in U.S. Pat. Nos. 2,933,390 and 3,635,721); aromatic organic acid/formaldehyde condensation products (e.g., as described in U.S. Pat. No. 3,743,510); and cadmium salts and azaindene compounds may be added to the photographic emulsion for said purpose.

When the hydrophilic colloid layer in the photographic materials of the present invention contains dyestuffs or ultraviolet absorbent, these may be mordanted by the use of a cationic polymer or the like.

The photographic materials of the present invention may contain as an anti-fogging agent, a hydroquinone derivative, an aminophenol derivative, a gallic acid derivative, or an ascorbic acid derivative.

The photographic materials of the present invention may contain in the hydrophilic colloid layer thereof an ultra-violet absorbent. For example, aryl-substituted benzotriazole compounds (e.g., as described in U.S. Pat. No. 3,533,794); 4-thiazolidone compounds (e.g., as described in U.S. Pat. Nos. 3,314,794 and 3,352,681); benzophenone compounds (e.g., as described in Japanese Patent Application (OPI) No. 2784/71); cinnamate compounds (e.g., as described in U.S. Pat. Nos. 3,705,805 and 3,707,375); butadiene compounds (e.g., as described in U.S. Pat. No. 4,045,229); and benzoxazole compounds (e.g., as described in U.S. Pat. No. 3,700,455) may be used. In addition, ultra-violet absorbing coupler (such as $\alpha$-naphthol-type cyan couplers) and ultra-violet absorbing polymers may also be used. Said ultra-violet absorbents may be mordanted in a special layer if desired.

The photographic materials of the present invention may contain, in the hydrophilic colloid layer thereof, a water-soluble dye, as a filter dye, for the purpose of irradiation prevention, or for various other purposes. Such water-soluble dyes include oxonole dyes, hemioxonole dyes, styryl dyes, merocyanine dyes, cyanine dyes, and azo dyes. Oxonole dyes, hemioxonole dyes and merocyanine dyes are preferred.

The photographic materials of the present invention may additionally contain a known color-deterioration inhibitor or a color image-stabilizers which may be used singly or in the form of a mixture of two or more kinds thereof Conventional color-deterioration inhibitors which may be used in the present invention are, for example, hydroquinone derivatives (e.g., as described in Japanese Patent Application (OPI) No. 10539/84), gallic acid derivatives, p-alkoxyphenols and bisphenols.

For the photographic treatment of the photographic materials of the present invention may be utilized conventional means. In accordance with the object and the use of the photographic materials, any conventional photographic treatment may be applied thereto, such as a black and white photographic treatment for formation of silver images, or other photographic treatment for formation of color images (e.g., a color development system, diffusion transfer system, or silver dye bleaching system).

The developer to be used for said black and white photographic treatment may contain a conventional developing agent such as dihydroxybenzenes or aminophenols, and other conventional additives.

The color development system comprises steps of color development, silver bleaching and fixation (or bleach-fix); and the silver dye bleaching system comprises steps of black and white development, dye-bleaching, silver-bleaching (or simultaneous dye and silver bleaching) and fixation.

A color developer to be used for said color development comprises, in general, an alkaline aqueous solution containing a color developing agent. As said color developing agent conventional aromatic primary amine developing agents such as phenylenediamines may be used. Said color developer may additionally contain a pH buffer, an anti-fogging agent, a development inhibitor, a preservative, a development accelerator, a color forming coupler, a competing coupler, a fogging agent, and an auxiliary developing agent.

The silver bleaching treatment may be carried out together with the fixation treatment. As a silver bleaching agent, polyvalent metal compounds such as iron (III)-compounds, peroxides, and quinones may be used.

Any conventional fixing agent may be used in the fixation solution, for example, thiosulfates, thiocyanates and organic sulfur-compounds may be used.

A PQ-type black and white developer is used, in general, in black and white development in the silver dye bleaching system.

In the dye-bleaching step, dyes are reduced and bleached by the use of a developed silver which has been formed in the photographic material and which acts as a catalyst. The dye-bleaching solution may contain an acid agent (such as a mineral acid or an organic acid), a compound which may form a silver salt or a silver complex (such as potassium bromide or thiourea), and dye-bleaching accelerator catalyst (such as pyrazine, phenazine, or naphthoquinone).

The present invention will be explained in greater detail by reference to the following examples, which, however, are not intended to be interpreted as limiting the scope of the present invention. In the examples, a polymer having a coupler residue (as a photographically useful group) and a polymer having a residue derived from a developing agent (as a photographically useful group) were used.

EXAMPLE 1

Layers, each comprising the components as set forth below, were coated on a cellulose triacetate film support, to obtain a sample (A).

1. Silver halide emulsion layer:

Red-sensitive silver bromoiodide emulsion (Silver iodide: 5 mole%)

Coated Silver Amount: 1.1 g/m$^2$

Gelatin: 1.2 g/m$^2$

Polymer coupler CP-4: 0.63 g/m$^2$

2. Protective layer

Gelatin: 1.0 g/m$^2$

Hardening agent HH-1 0.08 g/m$^2$ (used as a compound (2)):

Other samples (B) through (H) were analogously prepared, with the provisio that a magenta polymer coupler was added to a green-sensitive silver bromoiodide emulsion layer and a yellow polymer coupler was added to a blue-sensitive silver bromoiodide emulsion layer.

The thus obtained samples were subjected to wedge exposure with white light at a color temperature of 4800° K. and then to photographic treatments to obtain color images. The density of each of the thus-formed color images was determined.

Next, each sample was irradiated with a fluorescent light (20000 luxes) for one day. The difference between the density of the color image before the fluorescent irradiation and that after said irradiation was obtained. The color-fastness of the formed color image was evaluated on the basis of said difference.

The following Table 1 shows the maximum density of each of the samples (A) through (H) and the color retention percentage* (as defined below) at a color density of 1.0 of each sample. Hardening agent HH-1 can be represented by the formula

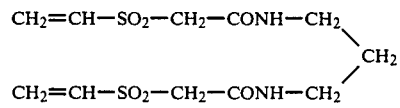

*Color retension percentage =

$$\frac{\text{Density after one day-irradiation with fluorescent light (20000 luxes)}}{\text{Density before irradiation}} \times 100(\%)$$

TABLE 1

| Sample | Polymer coupler (g/m$^2$) | Maximum density | Color retention percentage (%) | |
|---|---|---|---|---|
| A | CP-4 0.63 | 1.95 | 89 | Present invention |
| B | CH-1 0.72 | 1.80 | 80 | Comparative sample |
| C | MP-1 1.00 | 1.01 | 92 | Present invention |
| D | MP-7 1.05 | 1.12 | 90 | " |
| E | MH-1 0.48 | 0.97 | 65 | Comparative sample |
| F | MH-2 1.20 | 0.89 | 66 | " |
| G | YP-3 1.56 | 1.18 | 87 | Present invention |

TABLE 1-continued
| Sample | Polymer coupler (g/m$^2$) | Maximum density | Color retention percentage (%) | |
|---|---|---|---|---|
| H | YH-1 2.00 | 1.09 | 80 | Comparative sample |
(Compound described in Example 15 of U.S. Pat. No. 4,421,915)
CH-1
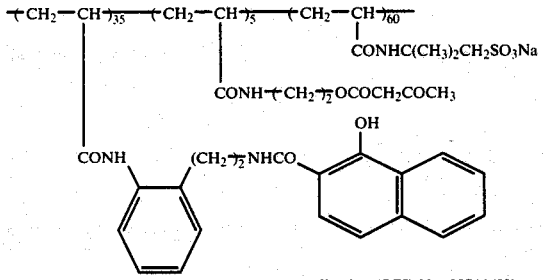
(Compound described in Japanese Patent Application (OPI) No. 28744/83)
MH-1
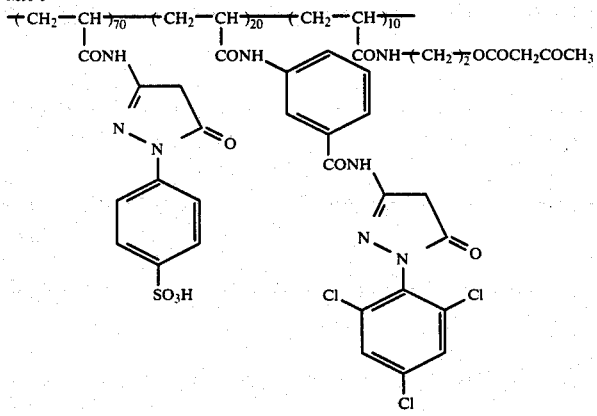
(Compound described in Example 18 of U.S. Pat. No. 4,421,915)
MH-2
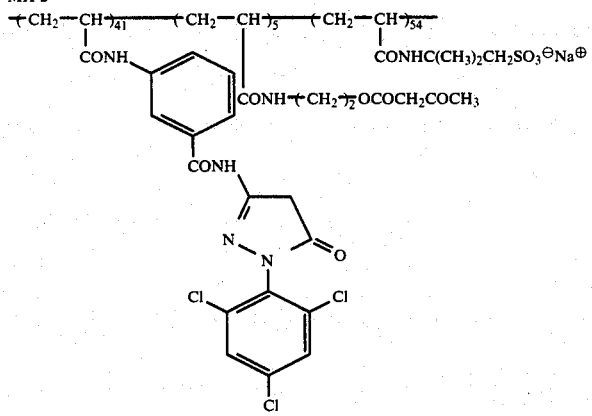
(Compound described in Example 17 of U.S. Pat. No. 4,421,915)
YH-1
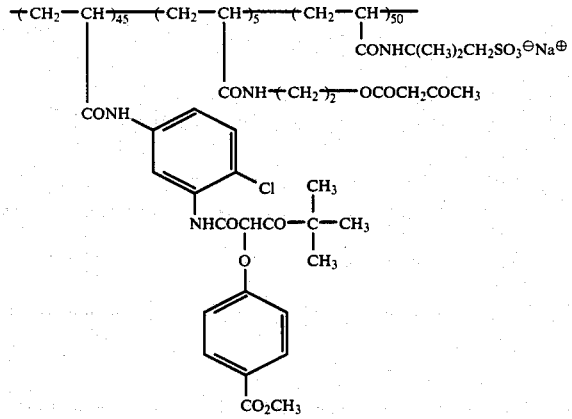

The Table-1 proves that the polymer coupler of the present invention, which has a sulfinic acid group as a reactive group, does not migrate into the development solution, and therefore a higher maximum density may be attained. Other polymer couplers having an active methylene group as a reactive group, as described in U.S. Pat. No. 4,421,915 or Japanese Patent Application (OPI) No. 28744/83 are inferior to said polymer coupler of the present invention.

In addition, it is apparent that the polymer couplers of the present invention form excellent color images (especially magenta images) which have high color-fasteness to light.

From the above results, it is recognized that the use of the polymers of the present invention having as a photographically useful group a coupler group remarkably improve the photographic characteristics, especially the maximum density of the color images formed and the color-fastness thereof to light.

EXAMPLE 2

Layers each comprising the components as set forth below were coated on a cellulose acetate film support, to obtain a sample (I).

1. Red-sensitive emulsion layer:

Silver bromoiodide emulsion (silver iodide: 5 mole%)
Coated Silver Amount: 1.6 g/m$^2$
Gelatin: 2.0 g/m$^2$
Tricresyl phosphate: 0.5 g/m$^2$
Coupler C-1: 0.7 g/m$^2$
Hardening agent HH-1 0.05 g/m$^2$ (used as a compound (2)):

2. Intermediate layer:

Polymer color-stain inhibitor DP-4: 0.11 g/m$^2$
Gelatin: 0.4 g/m$^2$

3. Magenta coupler layer:

Coupler M-1: 0.6 g/m$^2$
Gelatin: 1.2 g/m$^2$
Tricresyl phosphate: 0.5 g/m$^2$
Hardening agent HH-1: 0.05 g/m$^2$ Other samples (J) and (K) were prepared analogously, with the proviso that the sample (J) did not contain the polymer color-stain inhibitor DP-4, and that the sample (K) contained 0.24 g of DPH-1 instead of DP-4.

Thus formed samples were exposed and photographically treated analogously to Example 1, and the density of each of the formed color images were determined analogously. The following Table-2 shows the results.

TABLE 2

| Sample | Color-stain inhibitor (g/m$^2$) | Maximum density Cyan | Magenta | |
|---|---|---|---|---|
| I | DP-4 (0.11) | 1.56 | 0.01 | present sample |
| J | — (—) | 1.41 | 0.13 | comparative sample |
| K | DPH-1 (0.24) | 1.46 | 0.07 | comparative sample |

TABLE 2-continued

DPH-1 (Compound described in Example of Japanese Patent Application (OPI) NO. 27139/81)

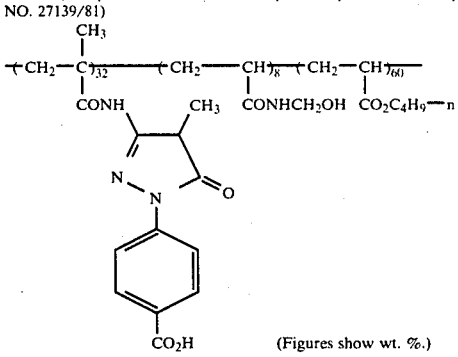

(Figures show wt. %.)

The data of Table-2 indicates that the polymer color-stain inhibitor of the present invention, which has a sulfinic acid group as a reactive group, does not migrate during development treatment, and appears to substantially trap the excess oxidation product of the developing agent, which was formed in the red-sensitive emulsion layer. Therefore, magenta development in the upper layer can be well restrained, as compared with the other comparative samples. In addition, it is recognized that the polymer color-stain inhibitor of the present invention can firmly be fixed in the intermediate layer, and thus, this does not hinder the cyan-color development in the red-sensitive emulsion layer, resulting in formation of cyan-color images of high density.

It is apparent from the above results, that the polymer color-stain inhibitor of the present invention, which contains a residue derived from a developing agent as a photographically group, has an excellent color-stain inhibitory effect.

Coupler C-1

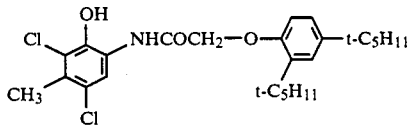

Coupler M-1

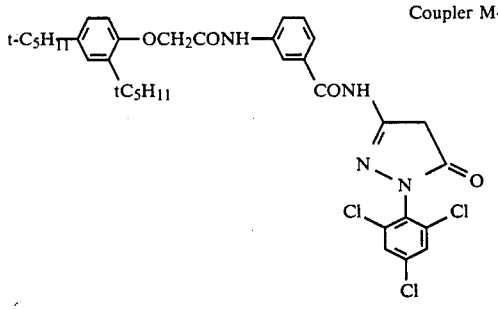

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising at least one layer which contains at least (1) a polymer comprising as constitutional components thereof a repeating unit having a photographically useful group and at least one repeating unit having a sulfinic acid group or a sulfinate group, and (2) a compound having at least one functional group which reacts with at least one of a sulfinic acid group and sulfinate group and at least one functional group which reacts with at least one of a sulfinic acid group, a sulfinate group and a primary amino group, the amount of compound (2) being sufficient to insure adequate fixation of the polymer but insufficient to cause difficulty of swelling the at least one layer.

2. A silver halide photographic material as in claim 1, wherein said photographically useful group in the polymer (1) is a group derived from a photographic dye, a development inhibitor, a development accelerator, a coupler, a competing coupler, a development inhibitor-releasing compound, a developing agent, a development auxiliary, a bleaching inhibitor, a bleaching accelerator, a bleaching accelerator-releasing compound, a silver halide solvent, a silver complexing agent, a fogging agent, an anti-fogging agent, a stabilizer, a chemical sensitizer, a spectral sensitizer, a desensitizer, an ultra-violet absorbent, an antioxidant, or a development accelerator-releasing compound, and precursors thereof.

3. A silver halide photographic material as in claim 1, wherein said photographically useful groupcontaining repeating unit in the polymer (1) is represented by formula (A)

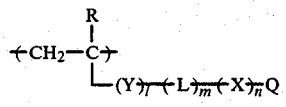

(A)

wherein

R is a hydrogen atom or an alkyl group having from 1 to 6 carbon atoms;

Y is

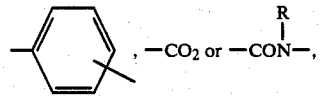

wherein R has the same meaning as above;

L is a divalent bonding group having from 1 to 12 carbon atoms;

X is —O—, —CO—, —$CO_2$—, —$SO_2$—,

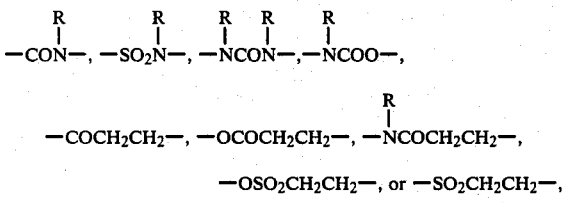

wherein R has the same meaning as above;

Q is a photographically useful group; and l, m, and n are each independently 0 or 1.

4. A silver halide photographic material as in claim 3, wherein L in said formula (A) represents an alkylene group, an arylene group or a group represented by the formula

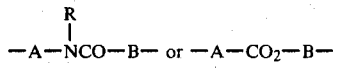

in which R is hydrogen atom or an alkyl group containing from 1 to 6 carbon atoms, and A and B each independently represents an alkylene group containing from 1 to 10 carbon atoms or an arylene group having from 6 to 10 carbon atoms, and said alkylene group and arylene group substituted by at least one member selected from an aryl group, nitro group, hydroxyl group, cyano group, an alkoxy group, an aryloxy group, an alkylcarbonyloxy group, an arylcarbonyloxy group, an alkylcarbonylamino group, a arylcarbonylamino group, a carbamoyl group, an alkylcarbamoyl group, a dialkylcarbamoyl group, an arylcarbamoyl group, an alkylsulfonyl group, an arylsulfonyl group, an alkylsulfonamido group, an arylsulfonamido group, a sulfamoyl group, an alkylsulfamoyl group, a dialkylsulfamoyl group, an arylsulfamoyl group, carboxyl group, an alkoxycarbonyl group, a halogen atom.

5. A silver halide photographic material as in claim 3, wherein Q in said formula (A) represents a cyan coupler group of formula (I)-1 or (I)-2

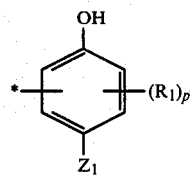

(I)-1

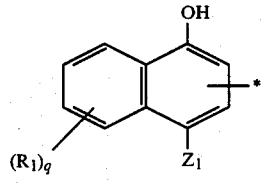

(I)-2 wherein the asterisk mark * shows the position of the bond to X;

$R_1$ represents an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an arylcarbamoyl group, an arylamido group, an arylsulfamoyl group, an arylsulfonamido group, or an arylureido group;

p is an integer of 0 to 3, and q is an integer of 0 to 4;

$Z_1$ represents a hydrogen atom, a halogen atom, a sulfo group, an acyloxy group, an alkoxy group, an aryloxy group, a heterocyclic oxy group, an alkylthio group, an arylthio group or a heterocyclic thio group, and these groups substituted by at least one member selected from an aryl group, a nitro group, a hydroxyl group, a cyano group, a sulfo group, an alkoxy group, an aryloxy group, an acyloxy group, an acylamino group, an alkylsulfonamido group, an alkylsulfamoyl group, a halogen atom, a carboxyl group, an alkylcarbamoyl group, an alkoxycarbonyl group, an alkylsulfonyl group, and an alkylthio group.

6. A silver halide photographic material as in claim 3, wherein Q in said formula (A) represents a magenta coupler group of one of formulae (I)-3 through (I)-14

(I)-3

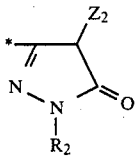

(I)-4

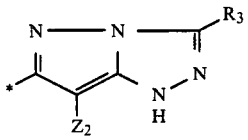

(I)-5

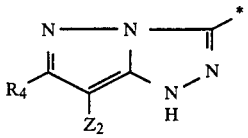

(I)-6

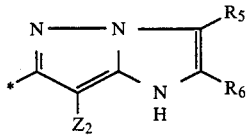

(I)-7

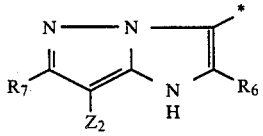

(I)-8

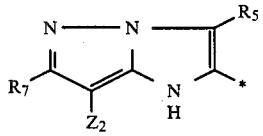

(I)-9

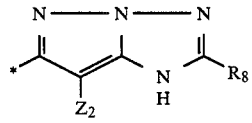

(I)-10

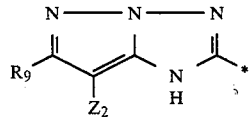

(I)-11

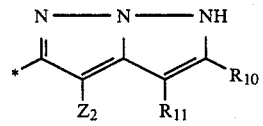

(I)-12

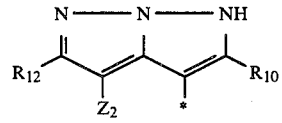

(I)-13

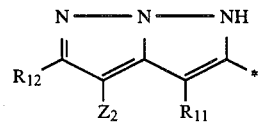

-continued (I)-14

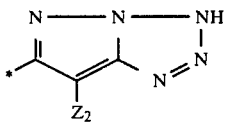

wherein the asterisk mark * shows the position of the bond to X;

$R_2$ represents an alkyl group, a substituted alkyl group, an aryl group, a substituted aryl group, an alkoxy group, an aryloxy group, an alkoxycarbonyl group, an acylamino group, a carbamoyl group, an alkylcarbamoyl group, a dialkylcarbamoyl group, an arylcarbamoyl group, an alkylsulfonyl group, an arylsulfonyl group, an alkylsulfonamido group, an arylsulfonamido group, a sulfamoyl group, an alkylsulfamoyl group, a dialkylsulfamoyl group, an arylsulfamoyl group, an alkylthio group, an arylthio group, a cyano group, a nitro group, and a halogen atom;

$R_3$, $R_4$, $R_5$, $R_6$, $R_7$, $R_8$, $R_9$, $R_{10}$, $R_{11}$ and $R_{12}$ each independently represents a hydrogen atom, a hydroxyl group, or a substituted or unsubstituted alkyl group, aryl group, heterocyclic group, alkylamino group, acylamino group, anilino group, alkoxycarbonyl group, alkylcarbonyl group, arylcarbonyl group, alkylthio group, arylthio group, carbamoyl group, sulfamoyl group, or sulfonamido group;

$Z_2$ represents a hydrogen atom, a halogen atom, or a split off group which is bonded at a coupling position via an oxygen, nitrogen, or sulfur atom.

7. A silver halide photographic material as in claim 3, wherein Q in said formula (A) represents a yellow coupler group of one of formulae (I)-15 through (I)-17

(I) - 15

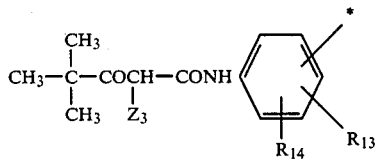

(I) - 16

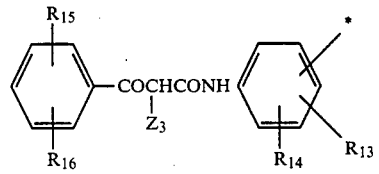

(I) - 17

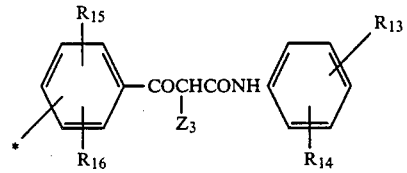

wherein the asterisk mark * shows the position of the bond to X;

$R_{13}$, $R_{14}$, $R_{15}$ and $R_{16}$ each independently represents a hydrogen atom, an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an alkyl-substituted succinimido group, an aryloxy group, an aryloxycarbonyl group, an arylcarbamoyl group, an arylamido group, an arylsulfamoyl group, an arylsulfonamido group, an arylureido group, a carboxyl group, a sulfo group, a nitro group, a cyano group, or a thiocyano group;

$Z_3$ represents a hydrogen atom or a group represented by one of formulae —$OR_{17}$,

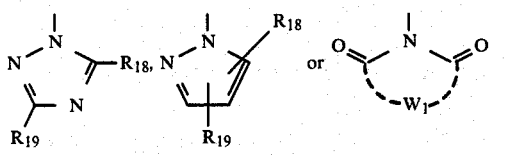

wherein $R_{17}$ represents an aryl group, a substituted aryl group, or a heterocyclic group, $R_{18}$ and $R_{19}$ each independently represents a hydrogen atom, a halogen atom, a carboxylic ester group, an amino group, an alkyl group, an alkylthio group, an alkoxy group, an alkylsulfonyl group, an alkylsulfinyl group, a carboxylic acid group, a sulfonic acid group, or a substituted or unsubstituted phenyl or heterocyclic group; and $W_1$ represents an atomic group forming a 4 to 7 membered ring together with

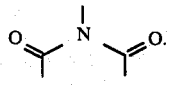

8. A silver halide photographic material as in claim 7, wherein $Z_3$ in said formulae (I)-15 through (I)-17 represents

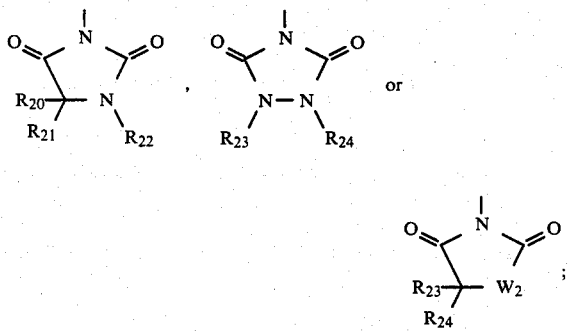

wherein $R_{20}$, $R_{21}$, $R_{22}$ each independently represents a hydrogen atom, an alkyl group, an aryl group, an aralkyl group, or an acyl group; $W_2$ represents an oxygen atom or a sulfur atom; $R_{23}$ and $R_{24}$ each independently represents a hydrogen atom, an alkyl group, an aryl group, an alkoxy group, an aryloxy group, or a hydroxy group.

9. A silver halide photographic material as in claim 3, wherein Q in said formula (A) represents a development inhibitor group of one of formulae (II)-1 through (II)-6

(II) - 1

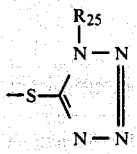

(II) - 2

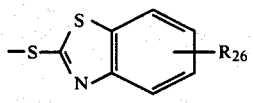

(II) - 3

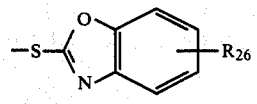

(II) - 4

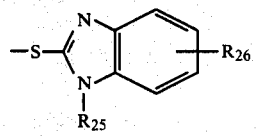

(II) - 5

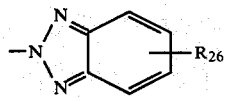

(II) - 6

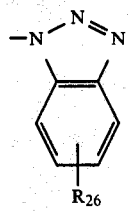

wherein $R_{25}$ represents a hydrogen atom, an alkyl group containing from 1 to 6 carbon atoms, a phenyl group or a substituted phenyl group; and $R_{26}$ represents a hydrogen atom, an alkyl group containing from 1 to 4 carbon atoms, a halogen atom, or a nitro group.

10. A silver halide photographic material as in claim 3, wherein Q in said formula (A) represents a developing agent group of one of formulae (III)-1 through (III)-6

(III)-1

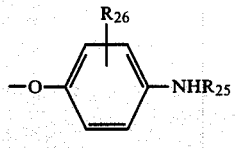

(III)-2

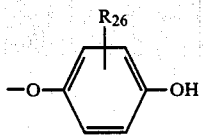

-continued (III)-3

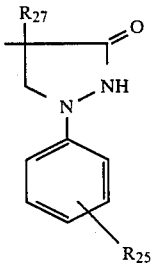

(III)-4

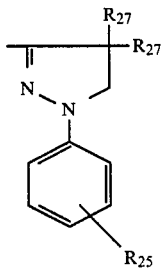

(III)-5

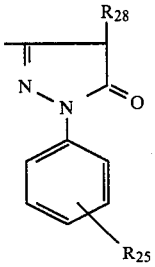

(III)-6

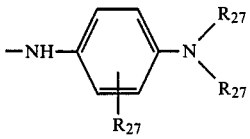

wherein $R_{25}$ represents a hydrogen atom, an alkyl group containing from 1 to 6 carbon atoms, a phenyl group or a substituted phenyl group; $R_{26}$ represents a hydrogen atom, a halogen atom, an alkyl group containing from 1 to 4 carbon atoms, or a nitro group; $R_{27}$ represents a hydrogen atom, an alkyl group containing from 1 to 4 carbon atoms, a hydroxyalkyl group containing from 1 to 4 carbon atoms or a sulfoalkyl group containing from 1 to 4 carbon atoms; and $R_{28}$ represents an alkyl group containing from 1 to 20 carbon atoms or an aryl group containing from 6 to 20 carbon atoms.

11. A silver halide photographic material as in claim 3, wherein Q in said formula (A) represents a bleaching inhibitor group of one of formulae (IV)-1 through (IV)-4

(IV)-1

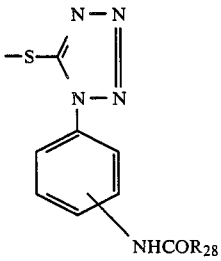

-continued (IV)-2

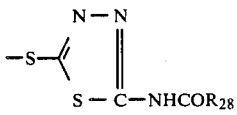

(IV)-3

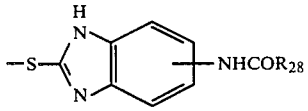

(IV)-4

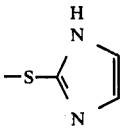

wherein $R_{28}$ represents an alkyl group containing from 1 to 20 carbon atoms or an aryl group containing from 6 to 20 carbon atoms.

12. A silver halide photographic material as in claim 3, wherein Q in said formula (A) represents an ultra-violet absorbent group of one of formulae (V)-1 through (V)-4

(V)-1

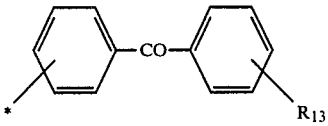

(V)-2

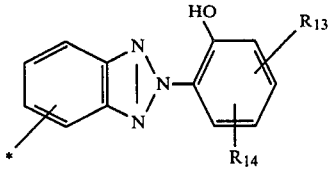

or

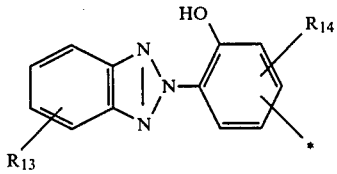

(V)-3

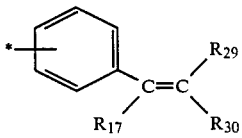

or

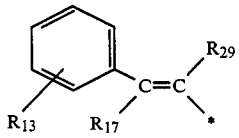

(V)-4

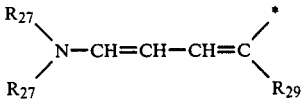

or

-continued

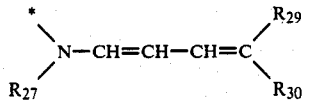

wherein $R_{13}$, and $R_{14}$ each independently represents a hydrogen atom, an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an alkyl-substituted succinimido group, an aryloxy group, an aryloxycarbonyl group, an arylcarbamoyl group, an arylamido group, an arylsulfamoyl group, an arylsulfonamido group, an arylureido group, a carboxyl group, a sulfo group, a nitro group, a cyano group, or a thiocyano group; $R_{17}$ represents an aryl group, a substituted aryl group, or a heterocyclic group; $R_{27}$ represents a hydrogen atom, an alkyl group containing from 1 to 4 carbon atoms, a hydroxyalkyl group containing from 1 to 4 carbon atoms, or a sulfoalkyl group containing from 1 to 4 carbon atoms; and $R_{29}$ and $R_{30}$ each independently represents a cyano group, an aryl group, an alkyl group, an alkoxycarbonyl group, an arylsulfonyl group, or an alkylsulfonyl group.

13. A silver halide photographic material as in claim 3, wherein Q in said formula (A) represents a group derived from a triarylmethane-type, azo-type, anthraquinone-type, merocyanine-type, oxonole-type, arylidene-type, or styryl-type dye.

14. A silver halide photographic material as in claim 1, wherein said sulfinic acid or sulfinate group-containing repeating unit in the polymer (1) is represented by a general formula (B):

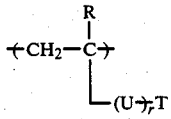

(B)

wherein

R is a hydrogen atom or an alkyl group containing from 1 to 6 carbon atoms;

U represents a divalent bonding group containing from 1 to 20 carbon atoms;

T represents a sulfinic acid group or a sulfinate group; and r is 0 or 1.

15. A silver halide photographic material as in claim 14, wherein U in said formula (B) represents an alkylene group, a phenylene group, an arylene-alkylene group, or a group represented by at least one of the formulae $—CO_2—$, $—CO_2—R_{30}—$, $—CONH—R_{30}—$ and

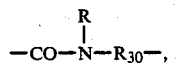

in which R has the same meaning as defined in claim 14, and $R_{30}$ represents an alkylene group, a phenylene group, or arylene-alkylene group.

16. A silver halide photographic material as in claim 1, wherein said polymer (1) contains at least one repeating unit other than said essential components of photographically useful group-containing repeating unit and at least one of sulfinic acid-containing repeating unit and sulfinate group-containing repeating unit.

17. A silver halide photographic material as in claim 16, wherein monomers forming said additional repeating unit is selected from the group consisting of ethylene, propylene, 1-butene, 1-vinyl imidazole, styrene, sodium vinylbenzenesulfonate, potassium vinylbenzylsulfonate, α-methyl-styrene, vinyltoluene, sodium vinylsulfonate, monoethylenic unsaturated ester of fatty acid, monoethylenic unsaturated amide of fatty acid, ethylenic unsaturated mono-carboxylic acid, di-carboxylic acid ester, ethylenic unsaturated monocarboxylic acid amide, mono-ethylenic unsaturated compound, and a diene.

18. A silver halide photographic material as in claim 1, wherein the content of said photograhically useful group-containing repeating unit is from 20 to 90 wt.%, the content of said sulfinic acid group-containing repeating unit and sulfinate group-containing repeating unit is from 2 to 50 wt%, and the content of said additional repeating unit is 70 wt.% or less.

19. A silver halide photographic material as in claim 1, wherein polymer (1) is a polymer containing a coupler group as a photographically useful group and said polymer has a molecular weight of from $5\times10^3$ to $1\times10^7$.

20. A silver halide photographic material as in claim 1, wherein said compound (2) is a photographic gelatin-hardening agent.

21. A silver halide photographic material as in claim 20, wherein said gelatin-hardening agent is selected from the group consisting of aldehydes, ketones, N-methylol compounds, dioxane derivatives, active vinyl compounds, active esters, active halogen-compounds, muco-halogenic acids, isoxazoles, dialdehyde-starches, 1-chloro-6-hydroxytriazinylated gelatins, high molecular weight activated vinyl compounds and high molecular weight activated-ester compounds.

22. A silver halide photographic material as in claim 21, wherein said gelatin-hardening agent is selected from vinylsulfonyl compounds and precursors thereof represented by formulae (C) and (D)

$$(CH_2{=}CH{-}SO_2)_2A \qquad (C)$$

$$(XCH_2CH_2{-}SO_2)_2A \qquad (D)$$

wherein A represents a divalent bonding group; X represents a mono-valent organic group which may be removed from the formula (D) in the form of a compound of HX, to form a compound of the formula (C).

23. A silver halide photographic material as in claim 22, wherein A in said formulae (C) and (D) represents a substituted or unsubstituted alkylene or phenylene group and alkylene group containing at least one ether and amido bond in the chain thereof.

24. A silver halide photographic material as in claim 26, wherein X in said formula (D) represents a halogen atom, an acyloxy group, or a sulfonyloxy group.

25. A silver halide photographic material as in claim 1, wherein said layer contains gelatin.

26. A silver halide photographic material as in claim 1, wherein said layer is an silver halide emulsion layer, an interlayer, a protective layer or a subbing layer.

27. A silver halide photographic material as in claim 1, wherein the amount of the compound (2) is from 0.05 to 10 molar times the amount of the sulfinic acid group or the sulfinate group contained in the polymer (1).

* * * * *